US009464488B2

(12) United States Patent
Thiessen

(10) Patent No.: US 9,464,488 B2
(45) Date of Patent: Oct. 11, 2016

(54) PERFORMING SIMULTANEOUS OPERATIONS ON MULTIPLE WELLBORE LOCATIONS USING A SINGLE MOBILE DRILLING RIG

(71) Applicant: National Oilwell Varco, L.P., Houston, TX (US)

(72) Inventor: Jay John Thiessen, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 394 days.

(21) Appl. No.: 14/040,837

(22) Filed: Sep. 30, 2013

(65) Prior Publication Data

US 2015/0090450 A1 Apr. 2, 2015

(51) Int. Cl.

| | |
|---|---|
| ***E21B 15/00*** | (2006.01) |
| ***E21B 33/06*** | (2006.01) |
| ***E21B 33/14*** | (2006.01) |

(52) U.S. Cl.

CPC ..... *E21B 15/003* (2013.01); *E21B 33/06* (2013.01); *E21B 33/14* (2013.01)

(58) Field of Classification Search

CPC ..... E21B 15/003; E21B 33/06; E21B 33/14
See application file for complete search history.

(56) References Cited

U.S. PATENT DOCUMENTS

| | | | | |
|---|---|---|---|---|
| 2,617,500 | A | 11/1952 | Cardwell et al. | 52/115 |
| 2,695,081 | A | 11/1954 | Woolslayer et al. | 52/119 |
| 2,840,198 | A | 6/1958 | Woolslayer et al. | |
| 2,887,191 | A | 5/1959 | Lovell | 52/115 |
| 3,161,259 | A | 12/1964 | Wilson | |
| 3,486,737 | A | 12/1969 | Campbell | 254/106 |
| 3,807,109 | A | 4/1974 | Jenkins et al. | 52/120 |
| 3,922,825 | A | 12/1975 | Eddy et al. | 52/116 |
| 3,942,593 | A | 3/1976 | Reeve et al. | 173/186 |

(Continued)

FOREIGN PATENT DOCUMENTS

| | | | |
|---|---|---|---|
| EP | 1 980 710 A2 | 10/2008 | |
| WO | WO 2004/035985 | 4/2004 | E21B 15/00 |

(Continued)

OTHER PUBLICATIONS

Office Action from related U.S. Appl. No. 13/863,680 dated Jun. 20, 2014.

(Continued)

*Primary Examiner* — Jennifer H Gay
(74) *Attorney, Agent, or Firm* — Amerson Law Firm, PLLC

(57) ABSTRACT

A system includes a drilling rig having a substructure, the drilling rig being adapted to be positioned above a plurality of wellbore location such that each of the plurality of wellbore locations is simultaneously positioned below the substructure. Equipment movement means is included for moving pressure control equipment between positions proximate each of the plurality of wellbore locations, the equipment movement means being adapted to move the pressure control equipment between the positions while the drilling rig is performing a rig operation on at least a first one of the plurality of wellbore locations. Equipment positioning means is included for positioning pressure control equipment on one or more of the plurality of wellbore locations, the equipment positioning means being adapted to position the pressure control equipment on a second one of the plurality of wellbore locations while the rig operation is being performed on the first wellbore location.

32 Claims, 23 Drawing Sheets

(56) References Cited

U.S. PATENT DOCUMENTS

| | | | | |
|---|---|---|---|---|
| 4,040,524 | A | 8/1977 | Lamb et al. | 414/22.52 |
| 4,063,650 | A * | 12/1977 | Homer | B63B 35/4413 105/29.1 |
| 4,108,255 | A | 8/1978 | Smith | 175/9 |
| 4,208,158 | A | 6/1980 | Davies et al. | 414/22 |
| 4,569,168 | A | 2/1986 | McGovney et al. | 52/122.1 |
| 4,587,778 | A | 5/1986 | Woolslayer et al. | 52/116 |
| 4,616,454 | A | 10/1986 | Ballachey et al. | 52/115 |
| 4,744,710 | A | 5/1988 | Reed | 414/22 |
| 4,819,730 | A | 4/1989 | Williford et al. | 166/355 |
| 4,899,832 | A | 2/1990 | Bierscheid, Jr. | 173/23 |
| 5,107,940 | A | 4/1992 | Berry | 175/85 |
| 5,492,346 | A | 2/1996 | Suksumake | 405/201 |
| 5,570,749 | A | 11/1996 | Reed | 175/66 |
| 5,921,336 | A | 7/1999 | Reed | |
| 6,047,781 | A | 4/2000 | Scott et al. | 175/5 |
| 6,056,071 | A | 5/2000 | Scott et al. | 175/5 |
| 6,068,069 | A | 5/2000 | Scott et al. | 175/5 |
| 6,085,851 | A | 7/2000 | Scott et al. | 175/7 |
| 6,158,516 | A | 12/2000 | Smith et al. | 166/385 |
| 6,161,358 | A | 12/2000 | Mochizuki et al. | 52/651.05 |
| 6,203,247 | B1 | 3/2001 | Schellstede et al. | 405/196 |
| 6,343,892 | B1 | 2/2002 | Kristiansen | 405/195.1 |
| 6,443,240 | B1 | 9/2002 | Scott | 175/7 |
| 6,554,075 | B2 * | 4/2003 | Fikes | E21B 15/003 166/379 |
| 6,634,436 | B1 | 10/2003 | Desai | |
| 6,719,062 | B2 * | 4/2004 | Fikes | E21B 15/003 166/379 |
| 6,766,860 | B2 | 7/2004 | Archibald et al. | 166/341 |
| 6,860,337 | B1 | 3/2005 | Orr et al. | 173/28 |
| 6,902,007 | B1 * | 6/2005 | Orr | E21B 33/06 166/379 |
| 6,932,553 | B1 | 8/2005 | Roodenburg et al. | 414/22.51 |
| 6,968,905 | B2 | 11/2005 | Adnan et al. | 166/384 |
| 6,973,979 | B2 | 12/2005 | Carriere et al. | 175/203 |
| 6,994,171 | B2 | 2/2006 | Orr et al. | 173/28 |
| 7,320,374 | B2 | 1/2008 | Folk et al. | 175/220 |
| 7,377,335 | B2 | 5/2008 | Jones et al. | 175/57 |
| 7,401,656 | B2 | 7/2008 | Wood et al. | 166/384 |
| 7,413,393 | B1 | 8/2008 | Barnes | 414/373 |
| 7,765,749 | B2 | 8/2010 | Palidis | |
| 7,828,087 | B2 | 11/2010 | Vora | 175/220 |
| 8,181,697 | B2 | 5/2012 | Springett et al. | 166/52 |
| 8,181,698 | B2 | 5/2012 | Springett et al. | 166/52 |
| 8,387,704 | B2 * | 3/2013 | Rodrigues | B63B 35/4413 166/352 |
| 9,091,126 | B2 * | 7/2015 | Thiessen | E21B 15/00 |
| 9,133,643 | B2 * | 9/2015 | Wasterval | E21B 15/00 |
| 2002/0074125 | A1 | 6/2002 | Fikes et al. | 166/352 |
| 2003/0098150 | A1 | 5/2003 | Andreychuk | 166/77.2 |
| 2003/0172599 | A1 | 9/2003 | Frink | 52/116 |
| 2004/0200641 | A1 | 10/2004 | Jones et al. | 175/57 |
| 2004/0211572 | A1 | 10/2004 | Orr et al. | 173/1 |
| 2004/0211598 | A1 | 10/2004 | Palidis | 175/162 |
| 2004/0240973 | A1 | 12/2004 | Andrews et al. | 414/332 |
| 2005/0161240 | A1 | 7/2005 | Orr et al. | |
| 2005/0193645 | A1 | 9/2005 | Barnes | 52/120 |
| 2007/0193749 | A1 | 8/2007 | Folk | 166/379 |
| 2007/0251725 | A1 | 11/2007 | Banks | 175/5 |
| 2008/0023228 | A1 | 1/2008 | Stevens | 175/57 |
| 2008/0251267 | A1 | 10/2008 | Cicognani | |
| 2009/0000218 | A1 | 1/2009 | Lee et al. | 52/123.1 |
| 2009/0025937 | A1 | 1/2009 | Robinson et al. | 166/351 |
| 2009/0218139 | A1 | 9/2009 | Donnally et al. | 175/57 |
| 2009/0218144 | A1 | 9/2009 | Donnally et al. | |
| 2009/0321135 | A1 | 12/2009 | Vora | 175/57 |
| 2010/0038088 | A1 * | 2/2010 | Springett | E21B 15/003 166/313 |
| 2010/0071906 | A1 * | 3/2010 | Rodrigues | B63B 35/4413 166/352 |
| 2010/0147524 | A1 * | 6/2010 | Springett | E21B 19/14 166/313 |
| 2010/0326734 | A1 * | 12/2010 | Wasterval | E21B 15/00 175/220 |
| 2011/0036662 | A1 * | 2/2011 | Smith | E04G 1/36 182/37 |
| 2011/0072737 | A1 | 3/2011 | Wasterval | 52/115 |
| 2012/0047820 | A1 | 3/2012 | Donnally et al. | 52/123.1 |
| 2012/0066999 | A1 | 3/2012 | Donnally et al. | |
| 2012/0067642 | A1 * | 3/2012 | Magnuson | E21B 15/003 175/7 |
| 2012/0138327 | A1 | 6/2012 | Sorokan et al. | 173/189 |
| 2012/0167485 | A1 | 7/2012 | Trevithick et al. | 52/112 |
| 2013/0098627 | A1 * | 4/2013 | Jordan | E21B 7/12 166/355 |
| 2013/0269268 | A1 | 10/2013 | Thiessen et al. | 52/118 |
| 2013/0318890 | A1 * | 12/2013 | Wasterval | E21B 15/00 52/123.1 |
| 2015/0090450 | A1 * | 4/2015 | Thiessen | E21B 15/003 166/285 |

FOREIGN PATENT DOCUMENTS

| | | | |
|---|---|---|---|
| WO | WO2008/103156 | 8/2008 | E21B 19/16 |
| WO | WO 2008/118914 | 10/2008 | E21B 7/12 |
| WO | 2009/138802 | 11/2009 | |
| WO | WO2010/019858 | 2/2010 | E21B 15/00 |

OTHER PUBLICATIONS

PCT International Search Report and Written Opinion dated Nov. 21, 2014 for International Application No. PCT/US2013/036860.

Related U.S. Appl. No. 13/863,680 Final Office Action dated Jan. 13, 2015.

Partial International Search (Annex to Form PCT/ISA/206) dated Apr. 3, 2014 for International Application No. PCT/US2013/036860, 4 pages.

PCT/US2009/053849 International Search Report (Dec. 2, 2009).

Office Action from parent U.S. Appl. No. 12/316,801 dated Feb. 24, 2011.

PCT Search Report and Written Opinion from PCT/US2010/058835 dated Feb. 21, 2012.

* cited by examiner

FIG. 3C
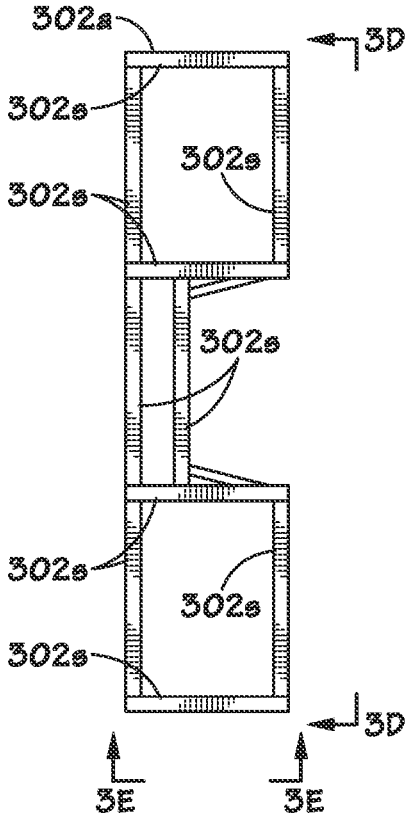
FIG. 3D
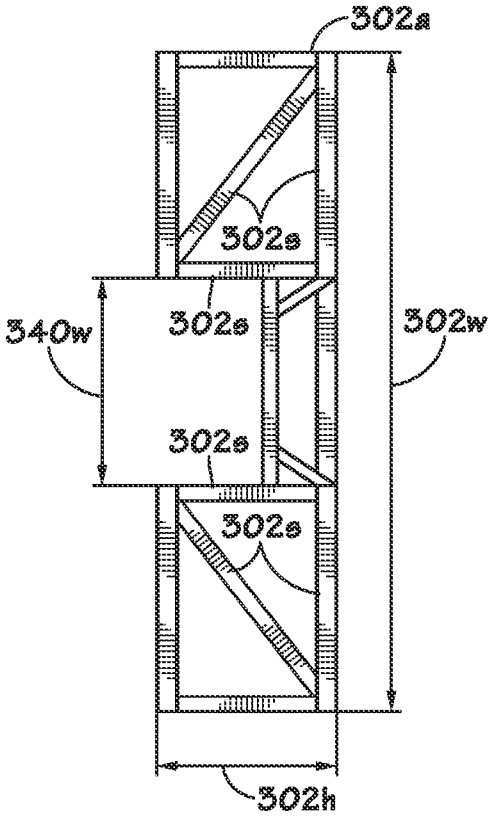
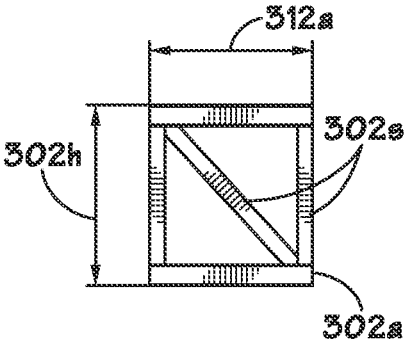
FIG. 3E

FIG. 3F
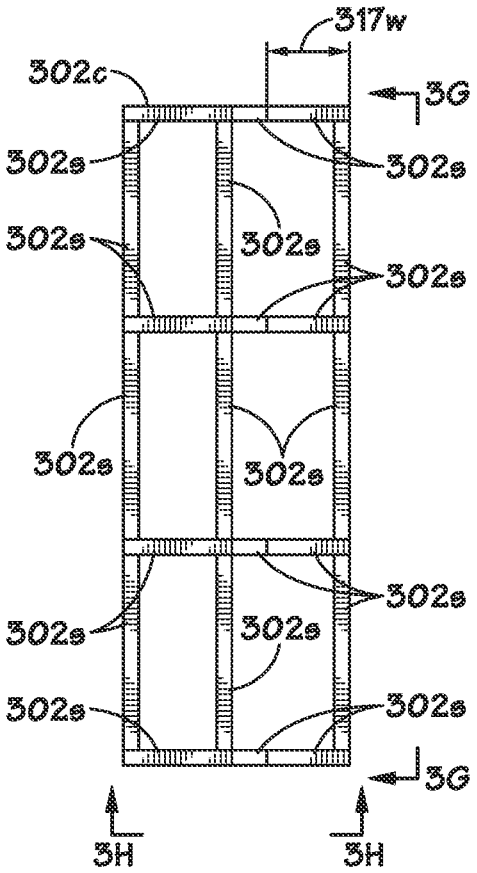
FIG. 3G
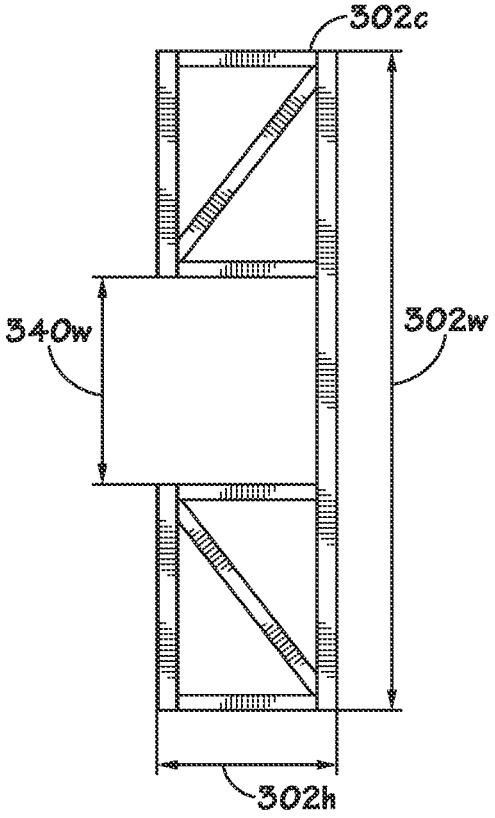
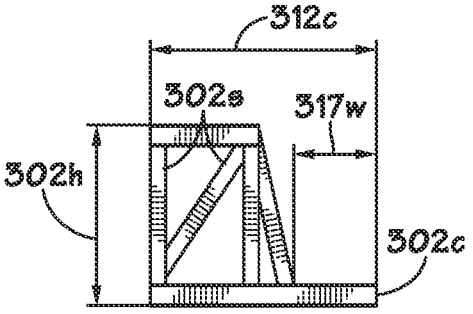
FIG. 3H

FIG. 3I
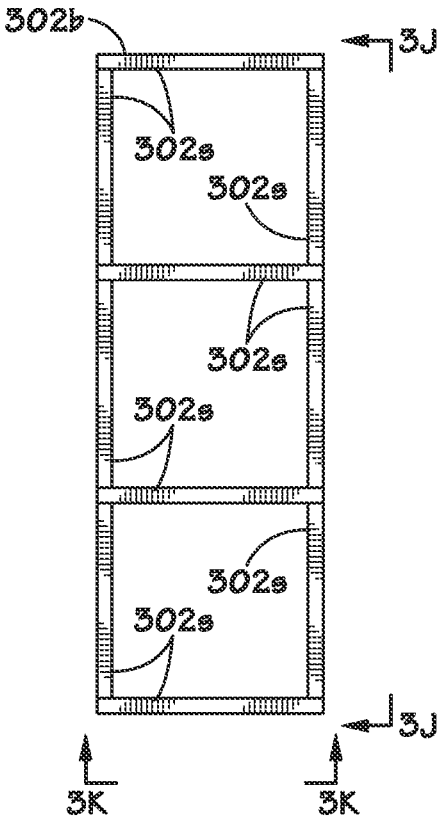
FIG. 3J
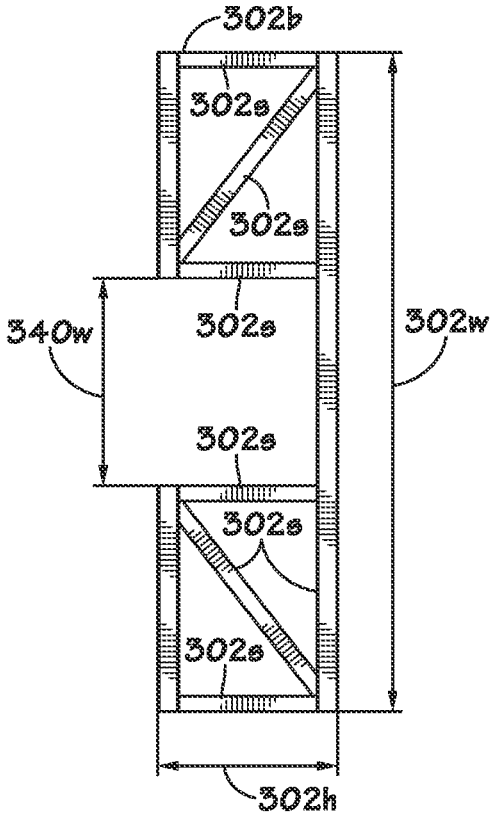
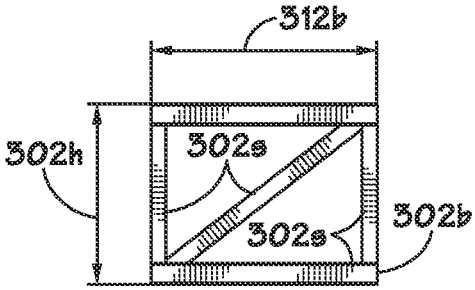
FIG. 3K

PERFORMING SIMULTANEOUS OPERATIONS ON MULTIPLE WELLBORE LOCATIONS USING A SINGLE MOBILE DRILLING RIG

BACKGROUND

1. Field of the Disclosure

The present subject matter is generally directed to performing drilling activities with mobile drilling rig assemblies, and in particular, to systems and methods that may be used to perform simultaneous operations on multiple wellbore locations with a single mobile drilling rig.

2. Description of the Related Art

In some land-based oil and gas drilling applications, the drilling operations that are performed at a given oilfield drilling site may involve drilling a plurality of relatively closely spaced wellbores, sometimes referred to as "pad" drilling operations. In pad drilling, the distance between adjacent wellbores may be as little as approximately 5-6 meters (16-20 feet) or even less, and the wellbores are oftentimes arranged in a two-dimensional grid pattern, such that rows and columns of wellbores are disposed along lines that run substantially parallel to an x-axis and a y-axis, respectively.

In such pad drilling applications, in order to maintain efficiency and overall cost-effectiveness of the drilling operations, it is necessary to move the drilling rig between such closely spaced adjacent wellbores after drilling operations have been completed at one wellbore. Accordingly, mobile—or even self-moving—drilling rigs are oftentimes employed in pad drilling operations, which thereby avoids the costly and time-consuming use of a crane for disassembling, lifting, and moving the various drilling rig components to the next wellbore location before drilling operations can recommence. The use of mobile drilling rigs helps to avoid a certain amount of "flat time" during the overall pad drilling operations, that is, the down time during which actual drilling wellbore drilling is not taking place, thereby more efficiently utilizing the time and capabilities of highly expensive drilling rigs.

However, it should be appreciated that, irrespective of the greater overall efficiency that mobile drilling rigs may bring to pad drilling applications, there is still a great amount of flat time associated with the conventional wellbore drilling activities associated with a given wellbore. Such additional flat time often occurs when ancillary wellbore operations other than the actual drilling—i.e., the time during which a drill string and drill bit are used to actually advance the wellbore into the earth—are performed when a drilling rig is in position above the wellbore. For example, the drilling rig cannot drill when the wellbore is being prepared for the drilling phase, such as by positioning a blowout preventer (BOP) on a wellhead and performing testing operations in order to ensure that wellbore drilling can be performed in a substantially safe fashion. Additionally, once a given section of the wellbore has been drilled to a desired depth, completion operations, including casing and cementing operations, must be performed to line the borehole so as to provide additional support and a pressure-tight seal.

During the casing operation, casing must be run into and set in the wellbore. Typically, the casing serves several purposes, including, among other things, preventing the drilled borehole from collapsing, providing a means of containing formation pressures, confining production to the wellbore, preventing inter-formational flow, and/or to permitting production from a specific zone. Thereafter, a cementing operation must be performed in order to provide support for and "bond" (i.e., attach) the casing to the formation, to protect the producing formations, to help in the control of blowouts from high-pressure zones, and/or to form a seal in the event of a "kick" during further drilling operations.

During the wellbore preparation phase described above, the drilling rig is essentially standing idle above the wellbore, other than to perhaps facilitate the lifting and placing of the BOP onto the wellhead. Additionally, while the drilling rig is actively working during the casing phase of completion operations, that is, when the casing is being run into the borehole, the drilling rig is again standing substantially idle above the wellbore during cementing operations, as drilling operations on subsequent deeper wellbore sections cannot commence until the cement has been pumped into place, and sufficient time has passed to allow the cement to set up. The additional flat time associated with the wellbore preparation and completion phases of the overall drilling program may thus have a significant impact on overall drilling costs at a given pad drilling site.

Accordingly, there is a need to develop and implement new designs and methods that maximize, or at least increase, the efficiency mobile drilling rigs when drilling closely-spaced adjacent wellbores during pad drilling operations. The following disclosure is directed to mobile drilling rig systems and methods that may be used to address, or at least mitigate, at least some of the problems outlined above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein relates to systems and methods that allow a single mobile drilling rig to be positioned above multiple different wellbore locations while simultaneously performing different rig operations with the single mobile drilling rig, such as wellbore preparation, drilling, and completion (e.g., cementing) operations, on each of the multiple different wellbores. In one exemplary embodiment, a system is disclosed that includes, among other things, a drilling rig having a substructure, the drilling rig being adapted to be positioned above a plurality of wellbore location such that each of the plurality of wellbore locations is simultaneously positioned below the substructure. The system further includes equipment movement means for moving pressure control equipment between positions proximate each of the plurality of wellbore locations, the equipment movement means being adapted to move the pressure control equipment between the positions while the drilling rig is performing a rig operation on at least a first one of the plurality of wellbore locations. Furthermore, the disclosed system also included equipment positioning means for positioning pressure control equipment on one or more of the plurality of wellbore locations, the equipment positioning means being adapted to position the pressure control equipment on a second one of the plurality of wellbore locations while the rig operation is being performed on the first wellbore location.

Another exemplary system disclosed herein includes a drilling rig having a substructure and a drill floor positioned above the substructure, the drilling rig being adapted to be positioned above a plurality of wellbore location such that each of the plurality of wellbore locations is simultaneously positioned below the substructure, and the drill floor having a plurality of openings, each of which is adapted to be positioned vertically above and substantially aligned with one of the plurality of wellbore locations. The system also includes, among other things, equipment movement means for moving pressure control equipment between positions proximate each of the plurality of wellbore locations, wherein the equipment movement means is adapted to move the pressure control equipment between the positions while the drilling rig is performing a first rig operation on a first one of the plurality of wellbore locations through a first one of the plurality of drill floor openings. Additionally, the disclosed system further includes equipment positioning means for positioning pressure control equipment on one or more of the plurality of wellbore locations, wherein the equipment positioning means is adapted to position the pressure control equipment on a second one of the plurality of wellbore locations while the first rig operation is being performed on the first wellbore location through the first drill floor opening.

Yet another disclosed illustrative embodiment is a system that includes, among other things, a mobile drilling rig that is adapted to be positioned above a plurality of wellbore locations, the mobile drilling rig having a drilling rig mast and a substructure that is configured so that each of the plurality of wellbore locations is simultaneously positioned within a cellar area of the substructure, wherein the mobile drilling rig is adapted to perform an on-line drilling operation on a first one of the plurality of wellbore locations and the drilling rig mast is adapted to be positioned above and substantially aligned with the first wellbore location during the on-line drilling operation. Furthermore, the system includes equipment movement means operatively coupled to the substructure and positioned in the cellar area thereof, the equipment movement means being adapted for moving pressure control equipment between positions proximate each of the plurality of wellbore locations while the mobile drilling rig is performing the on-line drilling operation on the first wellbore location. Also included in the disclosed exemplary system is equipment positioning means operatively coupled to the substructure and positioned in the cellar area thereof, the equipment positioning means being adapted for lifting pressure control equipment from the equipment movement means and positioning the pressure control equipment on at least one wellbore location that is immediately adjacent to the first wellbore location while the drilling rig is performing the on-line drilling operation on the first wellbore location.

Also disclosed herein is an illustrative method that includes positioning a substructure of a mobile drilling rig above at least first and second wellbore locations of a wellbore drilling site such that each of the first and second wellbore locations are simultaneously positioned within a cellar area of the substructure. Furthermore, the disclosed method includes, among other things, positioning a first blowout preventer on a first wellhead at the first wellbore location, positioning a second blowout preventer in the cellar area of the substructure, and performing a first on-line drilling operation on the first wellbore location through the first blowout preventer. Additionally, the method also includes moving the second blowout preventer within the cellar area to a second wellhead at the second wellbore location while performing the first on-line drilling operation, and after moving the second blowout preventer, performing a second on-line drilling operation on the second wellbore location through the second blowout preventer.

BRIEF DESCRIPTION OF THE DRAWINGS

The disclosure may be understood by reference to the following description taken in conjunction with the accompanying drawings, in which like reference numerals identify like elements, and in which:

FIGS. 2B-2J are elevation/section views from the V-door side, or front side, of the mobile drilling rig of FIG. 2A taken along the section line "2B-2B" during various exemplary steps of simultaneously performing wellbore preparation, drilling, and completion operations on at least some of the plurality of wellbore locations of the pad drilling site;

FIGS. 3C-3E are plan, side elevation, and end elevation views of a front side lower box of a lower substructure box assembly of the substructure assembly shown in FIG. 3A;

FIGS. 3F-3H are plan, side elevation, and end elevation views of a middle lower box of the lower substructure box assembly shown in FIG. 3A;

FIGS. 3I-3K are plan, side elevation, and end elevation views of a back side lower box of the lower substructure box assembly shown in FIG. 3A.

Figure 1A:
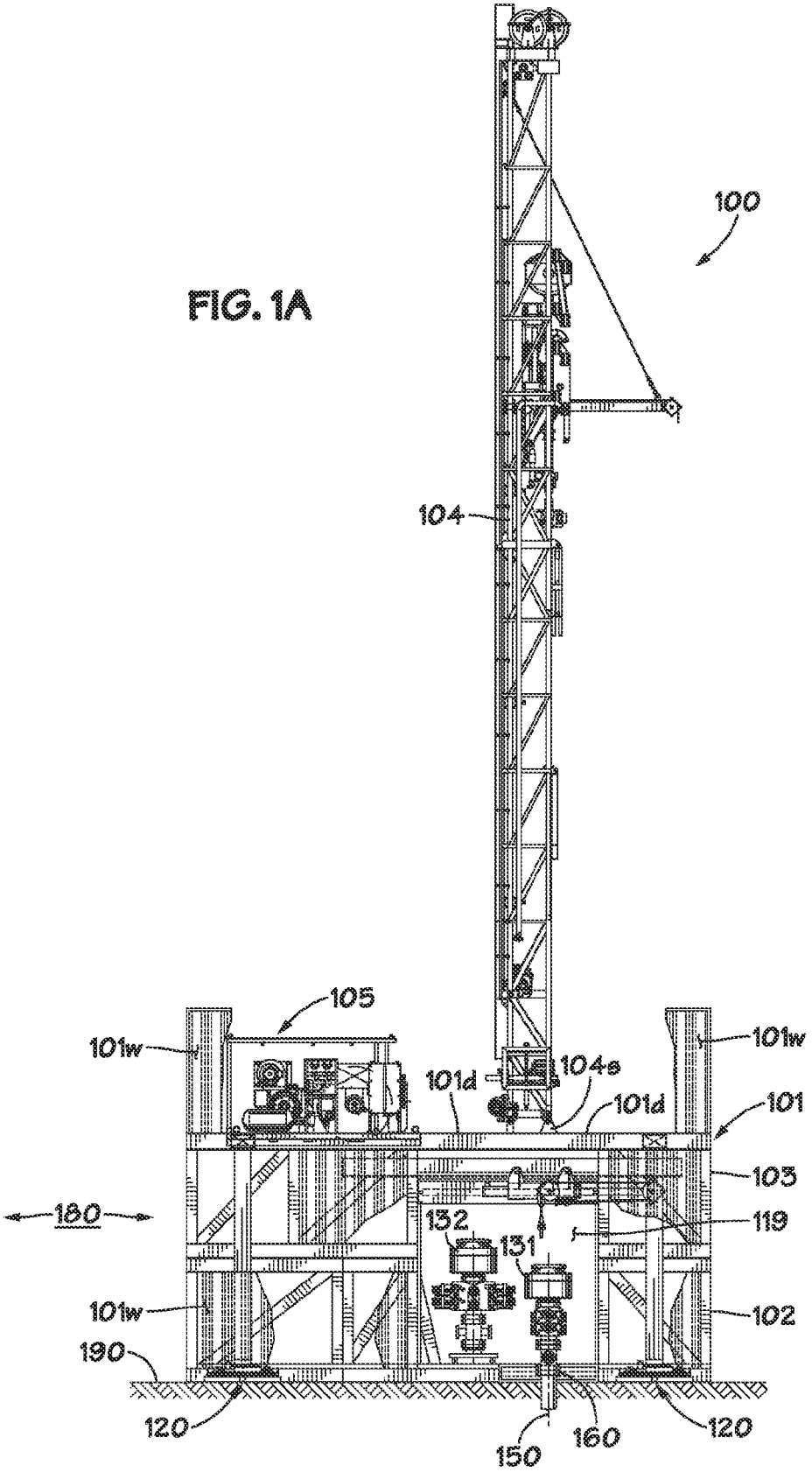
FIG. 1A is an elevation view of a mobile drilling rig in accordance with one illustrative embodiment of the present disclosure when viewed from the driller's side of the mobile drilling rig.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the presently disclosed subject matter relates to systems and methods that allow a single mobile drilling rig to be positioned above multiple different wellbore locations of a pad drilling site so that the mobile drilling rig can be used to simultaneously perform different rig operations, such as wellbore preparation, drilling, and/or cementing operations and the like, on each of the multiple different wellbore locations. In certain disclosed embodiments, a system may be provided that includes, among other things, means for moving different types of pressure control equipment, such as blowout preventers (BOP's), Christmas trees, and the like, back and forth between the wellheads of a plurality of different wellbores in a "leapfrog" fashion while the mobile drilling rig is positioned above the different wellbore locations. In this way, the disclosed systems may facilitate the performance of the various different types of operations that are necessary to prepare, drill, and complete each wellbore prior to moving the mobile drilling rig to one or more adjacent wellbore locations of the pad drilling site.

For example, the system may include means for moving pressure control equipment back and forth through the cellar area of the mobile drilling rig to positions proximate each of the multiple wellbore locations. For example, the means for moving pressure control equipment, hereinafter referred to equipment movement means, may be used to move the pressure control equipment along a line of wellbore locations over which the mobile drilling rig is positioned so that a particular type of pressure control equipment, e.g., a BOP or Christmas tree, can be positioned proximate a given wellbore location, wherein the specific type of pressure control equipment may depend on the type of rig activity that is to be performed at the wellbore. Furthermore, the equipment movement means is adapted to perform these equipment movement operations within the cellar area while the mobile drilling rig is simultaneously performing one or more rig operations, such as wellbore preparation, drilling, and/or cementing operations, on one or more of the multiple wellbore locations.

Additionally, the system may also include means for positioning pressure control equipment at an appropriate location, wherein the specific location may depend on a particular stage of the rig activity being performed. For example, once an appropriate type of pressure control equipment has been moved by the equipment movement means into a position proximate a specific wellbore location, the means for positioning pressure control equipment, hereinafter referred to as equipment positioning means, may be used to lift the pressure control equipment from the equipment movement means, and thereafter position it on the wellhead at the wellbore location. Similarly, the equipment positioning means may also be used to remove the pressure control equipment from the wellhead after a specific rig activity has been performed and completed, and thereafter position it on the equipment movement means so that the pressure control equipment can be moved to a different wellbore location for further rig activities. Moreover, as with the equipment movement means above, the equipment positioning means is also adapted to perform these equipment lifting and positioning operations while the mobile drilling rig is simultaneously performing one or more rig operations on one or more of the wellbore locations.

FIGS. 1A-1H, which are described in detail below, illustrate an exemplary embodiment of a mobile drilling rig that includes means for moving pressure control equipment between a plurality of closely spaced adjacent wellbore locations so as to facilitate the performance various different rig operations on each wellbore location, as is generally described above.

FIG. 1A is an elevation view of a mobile drilling rig 100 when viewed from the driller's side of the rig 100. The mobile drilling rig 100 includes a substructure assembly 101 that is positioned on the ground 190 at a well drilling location, such as a pad drilling site 180, or on a drilling pad (not shown) that is positioned on the ground 190. The substructure assembly 101 may be made up of a lower substructure box assembly 102 and an upper substructure box assembly 103 that is positioned above and fixedly attached to the lower substructure box assembly 102.

As shown in FIG. 1A, the mobile drilling rig 100 also includes a drilling rig mast assembly 104 that is positioned above the drill floor 101*d* of the substructure assembly 101. In some embodiments, the drilling rig mast assembly 104 may be pivotably attached to mast shoes 104*s* that are fixedly attached to the substructure assembly 101, and which may be used to facilitate the erection of the drilling rig mast assembly 104 during the overall assembly of the mobile drilling rig 100. In the rig arrangement depicted in FIG. 1A, the drilling rig mast assembly 104 is depicted in its position above with the wellbore location 150, and furthermore is substantially aligned with the wellbore location 150 in such a way as to enable drilling activities to be performed through the first BOP 131, which is mounted to a wellhead 160 at the wellbore location 150. Additionally, and depending on the overall design requirements, such as mast height and drilling or lifting loads and the like, the drilling rig mast assembly 104 may be made up of a single mast section, or it may include two or more mast subsections, which may be assembled either prior to, or in conjunction with, the erection of the mast 104. The mobile drilling rig 100 may also include a drawworks 105 that is positioned above the drill floor 101*d*, which may be used to facilitate lowering drill pipe into and raising drill pipe out of the wellbore 150 during drilling operations.

In some embodiments, the mobile drilling rig 100 may also include windwalls 101*w* that are either fixedly or removably attached to the substructure assembly 101 so as to create a substantially enclosed structure that may be at least partially protected from the weather during rig operations. It should be appreciated that the mobile drilling rig 100 may also include various other additional structures and/or rig elements that may be fixedly or removably attached to, or at least positioned proximate to, the rig 100. For example, the mobile drilling rig 100 may include a driller's cabin, an off-driller's side ancillary structure, pipe handling equipment, various rig processing modules, access stairways and platforms, and the like. However, for clarity, such additional structures and rig elements are not shown in the figures.

FIG. 1A also depicts the first BOP 131 and a second BOP 132 positioned in the cellar area 119, i.e., below the drill floor 101*d*, of the mobile drilling rig 100. In general, the cellar area 119 provides a substantially open area below the drill floor 101*d* that is adapted to facilitate performing the various requisite work activities around the BOP's 131 and 132 and/or the wellbore location 150. Furthermore, in the exemplary embodiment shown in FIG. 1A, the cellar area 119 also defines a substantially open passageway running completely through the substructure assembly 101 between the driller's side 112 and off-driller's side 113 (see, FIG. 1B) of the mobile drilling rig 100. This enables the mobile drilling rig 100 to be moved laterally over a plurality of wellbore locations that are substantially aligned with the wellbore location 150, i.e., along a line running between the driller's side 112 and off-driller's side 113, such as the wellbore locations 150*a* and 150*b* shown in FIGS. 1E-1F.

Figure 1B:
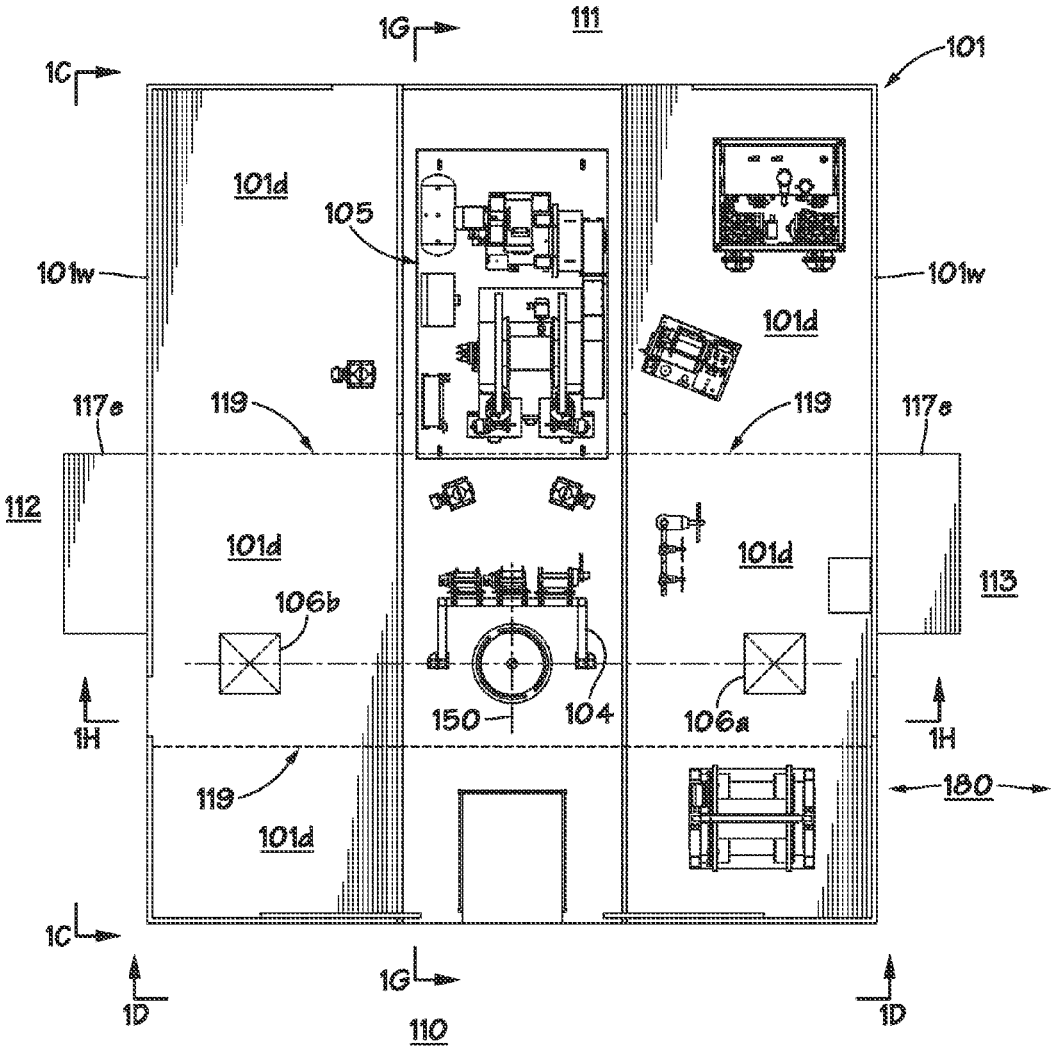
FIG. 1B is a plan view of the illustrative mobile drilling rig of FIG. 1A.

FIG. 1B is a plan view of the illustrative mobile drilling rig 100 shown in FIG. 1A. As shown in FIG. 1B, the mobile drilling rig 100 has a front side, or V-door side 110, where pipe handling equipment (not shown) may be positioned so as to move drill pipe into position, and a back side, or drawworks side 111, where the drawworks 105 is located. The mobile drilling rig 100 also has a driller's side 112, where the driller's cabin (not shown) is typically located, and an off-driller's side 113. Additionally, FIG. 1B shows that access hatches 106*a* and 106*b* may be located in the drill floor 101*d* and on the driller's side 112 and the off-driller's side, respectively, of the wellbore location 150 and the drilling rig mast assembly 104.

In certain exemplary embodiments, the access hatches 106*a*, 106*b* are substantially aligned with the respective wellbore locations 150*a*, 150*b* (see, FIGS. 1E-1F) of a pad drilling site 180 that are immediately adjacent to driller's side 112 and off-driller's side 113 of the wellbore location 150. The access hatches 106*a*, 106*b* are adapted to provide access down through substructure assembly 101 to the cellar area 119 (as indicated by dashed lines in FIG. 1B) adjacent to off-line wellbore locations 150*a*, 150*b*. In this way, off-line operations, such as, for example, wellbore cementing operations and the like, may be performed on either of the two adjacent driller's side 112 and off-driller's side 113 wellbore locations 150*a*, 150*b* through the respective access hatches 106*a*, 106*b* while on-line operations, such as drilling and/or running casing, are being performed on the working wellbore location 150 that is immediately below the drilling rig mast assembly 104. The specific steps associated with performing such on-line and off-line activities will be described in further detail with respect to FIGS. 2A-2J below.

Figure 1C:
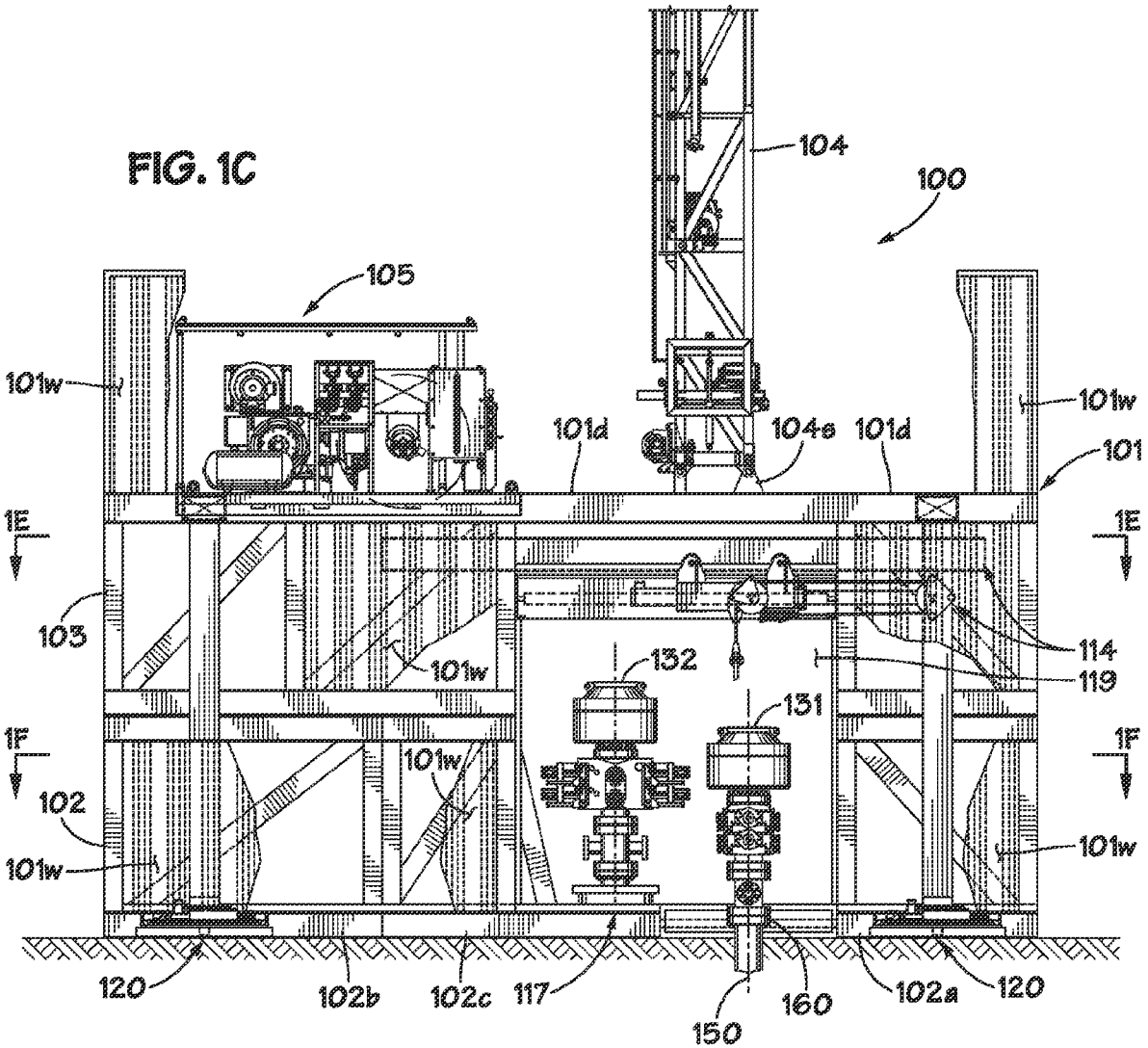
FIG. 1C is a close-up elevation view of the driller's side of the substructure assembly of the mobile drilling rig of FIGS. 1A and 1B taken along the view line "1C-1C" of FIG. 1B.

FIG. 1C is a close-up elevation view of the driller's side 112 of the substructure assembly 101 of the mobile drilling rig 101 of FIGS. 1A and 1B taken along the view line "1C-1C" as shown in FIG. 1B, wherein, for clarity, only a lower portion of the drilling rig mast assembly 104 has been depicted. As shown in FIG. 1C, the first BOP 131 is positioned above a wellbore 150, and furthermore is mounted on the wellhead 160 at the wellbore 150. On the other hand, the second BOP 132 is positioned on equipment movement means 117, which is adapted to move various different types of pressure control equipment, such as, among other things, the BOP's 131, 132 and/or Christmas trees 133 (see, FIG. 1H), between different wellbore locations so as to facilitate the performance of different rig activities, as will be described further in conjunction with FIGS. 1E-1G below.

Figure 1D:
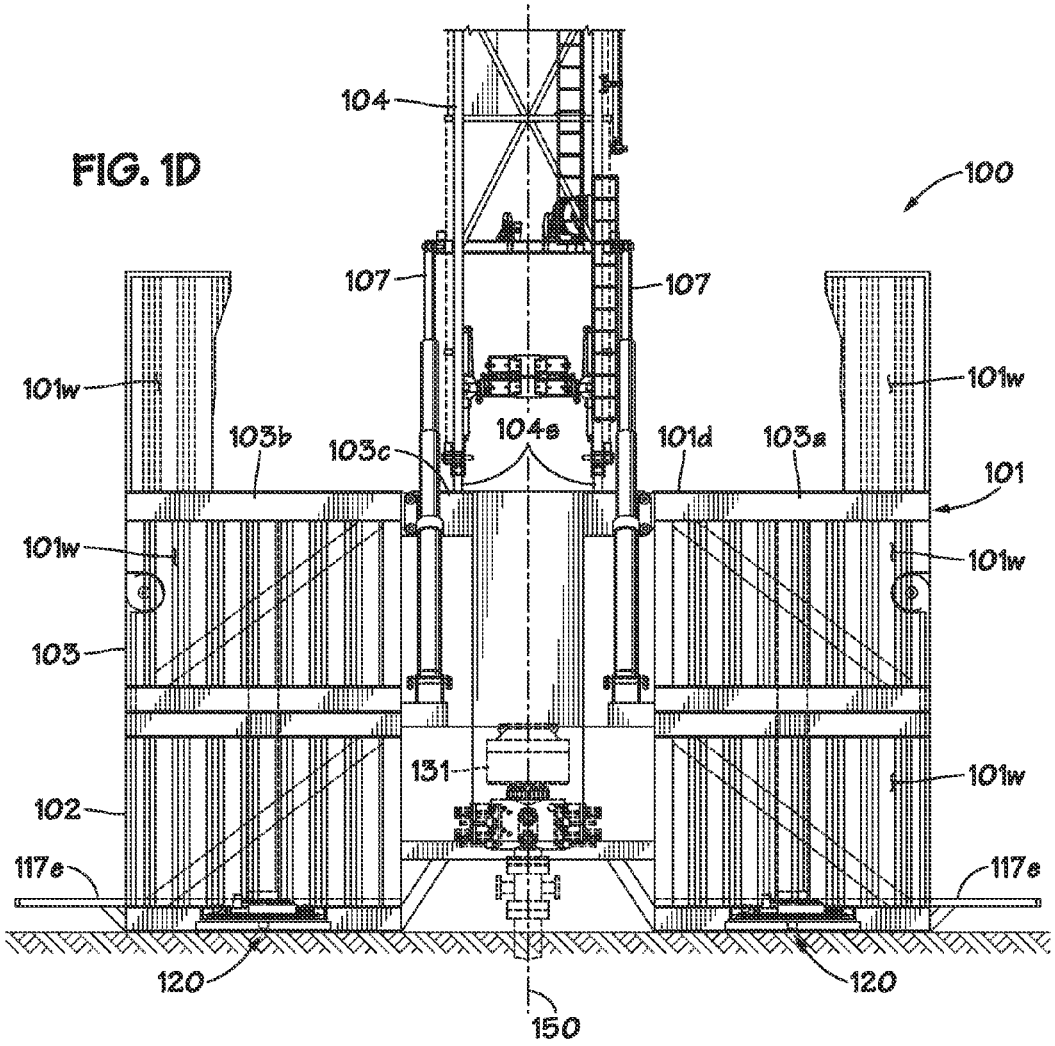
FIG. 1D is a close-up elevation view of the V-door side, or front side, of the substructure assembly of the mobile drilling rig of FIGS. 1A and 1B taken along the view line "1D-1D" of FIG. 1B.

In some illustrative embodiments, equipment hoisting means 114 may also be positioned in the cellar area 119 of the mobile drilling rig 100 and above the wellbore location 150, where it may be operatively coupled to the substructure assembly 101, such as to the center floor section 103*c* (see, FIG. 1D). Equipment hoisting means 114 may be used for lifting pressure control equipment, such as the first BOP 131, off of the wellhead 160 at the wellbore location 150. Additionally, equipment hoisting means 114 may be adapted to move pressure control equipment, e.g., BOP's and Christmas trees, into and out of an equipment workshop area 140 (see, FIGS. 1E-1F) within the area of substructure assembly 101 that is located substantially below the drawworks 105 while one or more rig operations, e.g., wellbore preparation, drilling, and/or cementing and the like, are being performed on any one or more of the wellbore locations 150, 150*a* and/or 150*b* (see, FIGS. 1E-1F), as will be further described below.

Figure 1E:
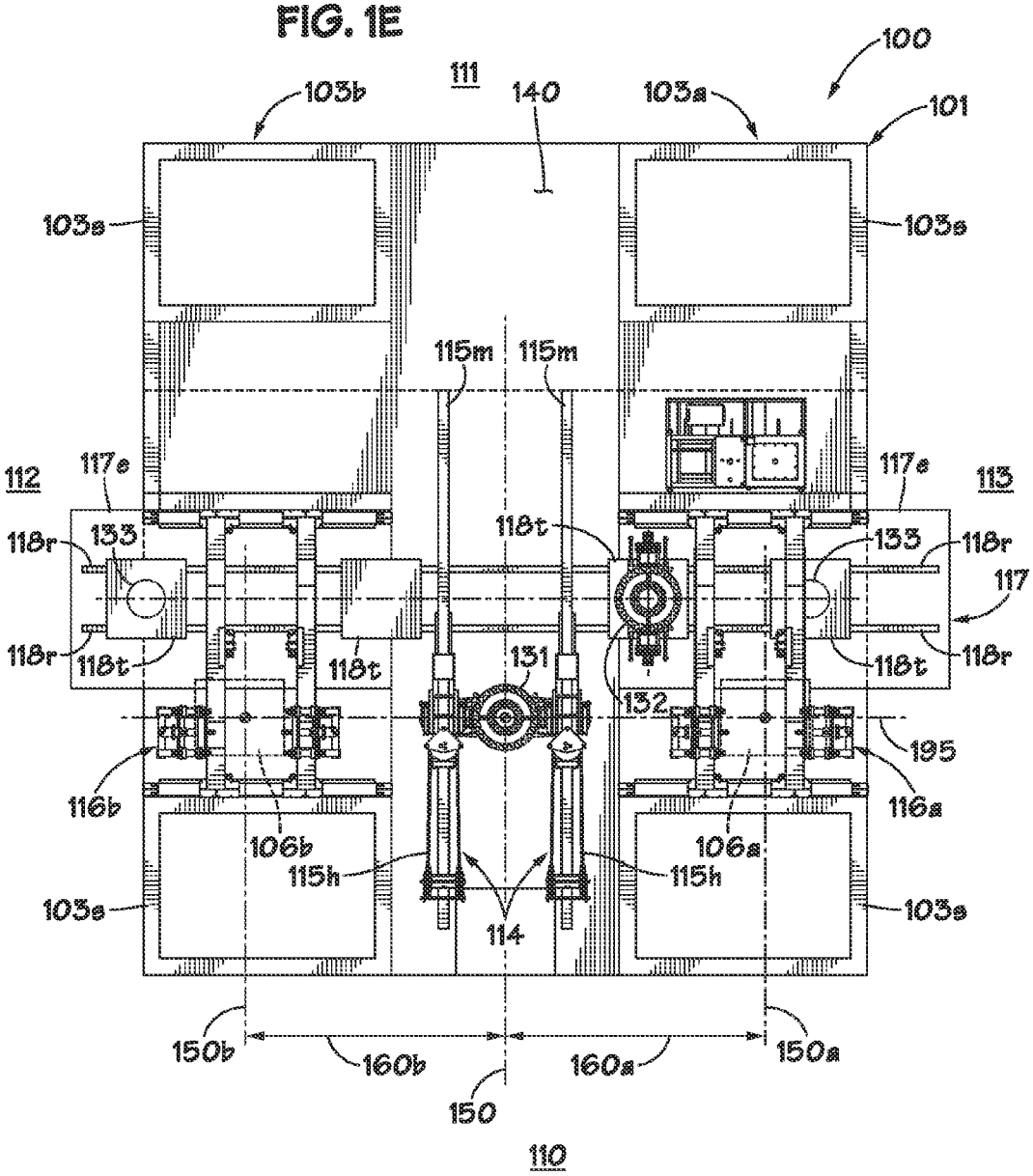
FIG. 1E is a plan/section view of the substructure assembly of the mobile drilling rig of FIGS. 1A-1C taken along the section line "1E-1E" of FIG. 1C.
Figure 1F:
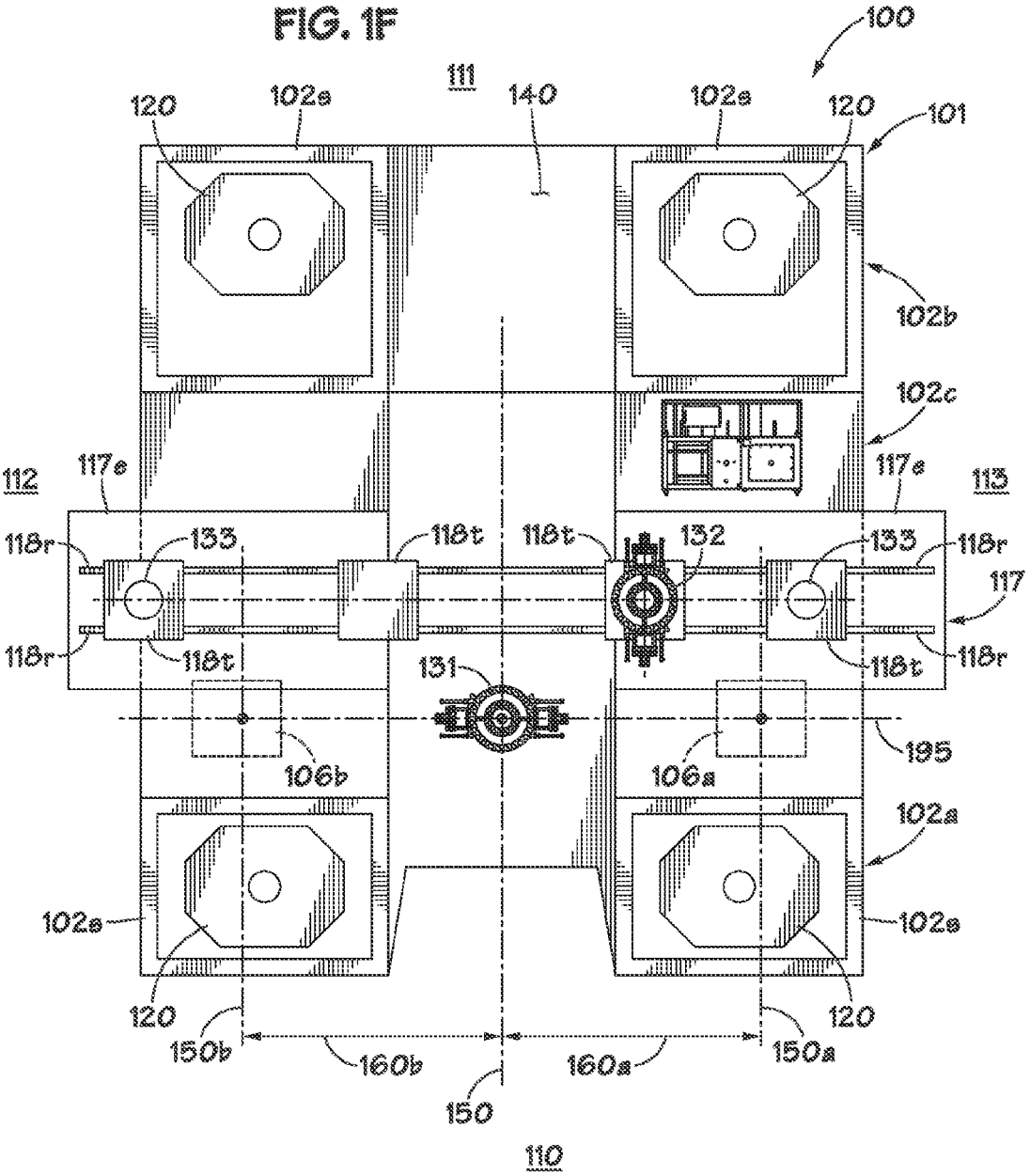
FIG. 1F is a plan/section view of the substructure assembly of the mobile drilling rig of FIGS. 1A-1C taken along the section line "1F-1F" of FIG. 1C.

As shown in FIG. 1C, the mobile drilling rig 100 may also include rig movement means 120, which may be adapted to move the mobile drilling rig 100 from a first location wherein the drilling rig mast assembly 104 is positioned for drilling operations substantially above the wellbore location 150, to a second location wherein the mast 104 is positioned for drilling operations substantially above an adjacent wellbore location 150*a* or 150*b* (see, FIGS. 1E-1F). In some illustrative embodiments, rig movement means 120 may be, for example, the means for moving a fully assembled mobile drilling rig as is described in U.S. patent application Ser. No. 13/863,680 and incorporate herein by reference for all purposes. Additional details of rig movement means 120 are also described in conjunction with FIG. 1G below.

FIG. 1D is a close-up elevation view of the V-door side 110 of the substructure assembly 101 of the mobile drilling rig 100 of FIGS. 1A and 1B taken along the view line "1D-1D" of FIG. 1B, wherein, again for clarity, only a lower portion of the drilling rig mast assembly 104 has been depicted. As shown in FIG. 1D, the mobile drilling rig 100 may also include a plurality of mast raising apparatuses 107, such as telescoping hydraulic cylinders and the like, which may be used to erect the drilling rig mast assembly 104 after it has been pivotably attached to the mast shoes 104*s* above the drill floor 101*d*.

FIG. 1E is a plan/section view through the substructure assembly 101 of the mobile drilling rig 100 of FIGS. 1A-1C taken along the section line "1E-E" of FIG. 1C. It should be noted that only a general outline of the structural components of the substructure assembly 101 is depicted in FIG. 1E, for clarity. As shown in FIG. 1E, equipment hoisting means 114 substantially straddles the wellbore location 150. In some exemplary embodiments, equipment hoisting means 114 may include hoisting apparatuses 115*h* that are movably mounted on monorails 115*m*. For additional detail, see, FIG. 1G. Additionally, equipment hoisting means 114 may be adapted to lift the first BOP 131 off of the wellhead 160 at the wellbore location 150, such as during an emergency shutdown situation requiring BOP repair, by actuating the hoisting apparatuses 115*h* and moving the BOP 131 along the monorails 115*m* and into the equipment workshop area 140 within the area the substructure assembly 101 that is generally below the drawworks 105 (see, FIGS. 1A and 1C). Furthermore, equipment hoisting means 114 may also be adapted to move other pressure control equipment, such as other BOP's and/or Christmas trees, out of the equipment workshop area 140, e.g., after equipment maintenance and/or repair, and position the pressure control equipment on equipment movement means 117 for movement proximate another wellbore location that is positioned below the drill floor 101*d* of the mobile drilling rig 100, e.g., wellbore locations 150*a* and/or 150*b*.

As may be appreciated, while it is highly desirable for each of the various wellbore locations that are being worked on by the mobile drilling rig 100—such as the wellbore locations 150*a*, 150, and 150*b* shown in FIG. 1E—to be perfectly aligned and equally spaced apart, such perfect alignment and spacing accuracy is typically not achievable in a real-world drilling situation. This may particularly be the case in those drilling programs where it may be more cost effective for each of the wells on a given pad drilling site to be initially spudded to a relatively shallow first section depth, such as 6-20 meters (20-65 feet), and the conductor casing set and cemented using a less costly drilling rig, or even multiple drilling rigs. Accordingly, it is sometimes the case that a more sophisticated rig, such as the exemplary mobile drilling rig 100 disclosed herein, may not be moved in to drill the various wellbore locations of the pad drilling site to total depth (TD) until after the conductor casing for each wellbore has already been set. In such instances, the mobile drilling rig 100 will therefore have to work the various adjacent wellbore locations based upon the actual position of each wellbore, and not some theoretical position relative to a straight line and constant equal spacing.

For example, while it may be advantageous for each of the wellbore locations that are positioned below the drill floor 101*d* of the substructure assembly 101 at any given time during rig activities—such as the wellbore locations 150*a*, 150, and 150*b*—to be perfectly aligned along a straight line—such as the line 195 shown in FIG. 1E—it may only be possible to achieve a nominal alignment with respect to the line 195 that is within a given alignment tolerance, such as ±0.1 meters (±4 inches), or even greater. Furthermore, the spacing between adjacent wellbore locations—such as the distance 160*a* between wellbore locations 150*a* and 150, and/or the distance 160*b* between the wellbore locations 150 and 150*b*—may be subject to a similar spacing tolerance (e.g., ±0.1 meters). Therefore, since the drilling rig mast assembly 104 must be substantially aligned with center wellbore location 150 during on-line drilling operations, and since the dimensions of the mobile drilling rig 100 relative to the position of mast 104 are fixed, some degree of adjustments may be required in order to properly position the necessary pressure control equipment on the adjacent wellbore locations 150*a* and/or 150*b* so that off-line operations, such as wellbore preparation and/or cementing operations, can be simultaneously performed on either or both of the adjacent locations while on-line drilling operations on wellbore location 150 continue.

In order to account for the numerous possible variations in the actual locations of the off-line wellbore locations 150*a*, 150*b* relative to the on-line (center) wellbore location 150, the mobile drilling rig 100 may also include, in certain illustrative embodiments, equipment positioning means 116*a* and 116*b* that are adapted to lift and accurately position the required pressure control equipment, such as BOP's and/or Christmas trees, on a wellhead 160 at the respective adjacent driller's side 112 and off-driller's side 113 wellbore locations 150*a* and 150*b*. In particular, equipment positioning means 116*a* and 116*b* may be adapted to lift the pressure control equipment from equipment movement means 117, which may have previously been used to position the pressure control equipment proximate a respective wellbore location 150*a*, 150*b*, as is discussed in further detail with respect to FIGS. 1F-1H below. Furthermore, unlike equipment hoisting means 114—which may only be adapted to move the pressure control equipment along a path that is substantially transverse, or perpendicular, to the nominal wellbore location line 195—equipment positioning means 116*a* and 116*b* may also be adapted to move the pressure control equipment along two different paths, i.e., substantially transverse to the line 195, as well as substantially parallel to the line 195. In this way, equipment positioning means 116*a*, 116*b* may be used to accurately position pressure control equipment on a respective adjacent wellbore location 150*a*, 150*b* even in those instances where the wellbores 150*a*, 150*b* may be imperfectly located relative to the wellbore location line 195 and the nominal wellbore spacing 160*a*, 160*b*.

In some embodiments, equipment positioning means 116*a* and 116*b* may be, for example, bridge cranes and the like, which may thereby allow movement of the pressure control equipment along two substantially perpendicular axes—e.g., transverse and parallel to the nominal wellbore location line 195. Furthermore, equipment positioning means 116*a*, 116*b* may be operatively coupled to the upper substructure assembly 103. For example, in those embodiments wherein equipment positioning means 116*a* and 116*b* are bridge cranes, each bridge crane 116*a*, 116*b* may be appropriately attached to the structural members 103*s* (see, FIG. 1G) of a respective off-driller's side 113 or driller's side 112 upper box 103*a*, 103*b*.

FIG. 1F is a plan/section view through the substructure assembly 101 of the mobile drilling rig 100 of FIGS. 1A-1C taken along the section line "1F-1F" of FIG. 1C. It should be noted that, as with FIG. 1E above, only a general outline of the structural components of the substructure assembly 101 is shown in FIG. 1F, for clarity. Additionally, rig movement means 120 is only schematically illustrated.

In general, equipment movement means 117 is arranged such that equipment may be moved along a path that is substantially aligned with, or parallel to, the nominal wellbore location line 195. In this way, equipment movement means 117 may be used to move pressure control equipment, such as BOP's, Christmas trees, and the like, back and forth along the nominal wellbore location line 195 between the wellbore location 150 (above which the drilling rig mast assembly 104 is positioned for drilling) and each of the adjacent wellbore locations 150*a* and 150*b* (above which the access hatches 106*a* and 106*b* are positioned for performing off-line operations). See, FIG. 1B. Furthermore, as shown in FIG. 1F, equipment movement means 117 may extend laterally across substantially the full width of the substructure assembly 101, i.e., from the driller's side 112 to the off-driller's side 113, so that the pressure control equipment can be positioned close enough to one of the adjacent off-line wellbore locations 150*a*, 150*b* so that a respective equipment positioning means 116*a*, 116*b* can used to lift and properly position the equipment, as described above.

In certain embodiments, equipment movement means 117 may be, for example, a trolley system, which may include a rail system, such as a pair of rails 118*r* and the like, and a plurality of trolley cars 118*t* movably mounted on the rails 118*r*. The trolley cars 118*t* may be adapted to support and move the various pieces of pressure control equipment, e.g., BOP's and/or Christmas trees, back and forth to substantially any position along the length of the rails 118*r*, including positions proximate each of the off-line wellbore locations 150*a*, 150*b*. Furthermore, in at least some embodiments, the rails 118*r* may extend beyond the sides of the substructure 101, in which case the ends of the rails 118*r* may be supported by rail extension supports 117*e*, as shown in FIG. 1F.

Figure 1G:
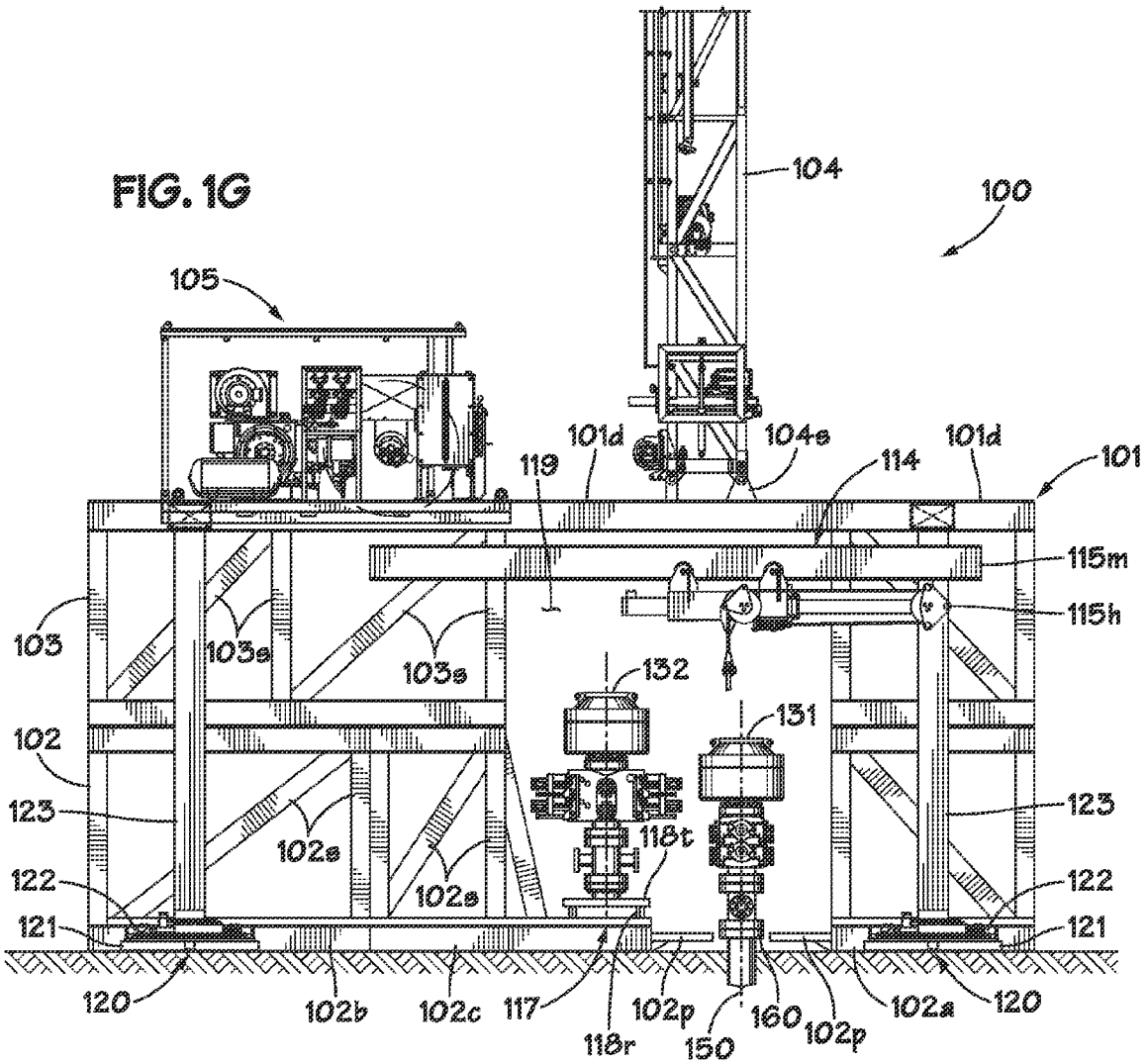
FIG. 1G is a close-up elevation/section view through the cellar area within the substructure assembly of the mobile drilling rig shown in FIGS. 1A and 1B taken along the section line "1G-1G" of FIG. 1B.

FIG. 1G is a close-up elevation/section view through the cellar area 119 within the substructure assembly of the mobile drilling rig shown of FIGS. 1A and 1B taken along the section line "1G-1G" of FIG. 1B, wherein only the lower portion of the drilling rig mast assembly 104 has been shown for clarity. As shown in FIG. 1G, the upper substructure box assembly 103 is made up of a plurality of structural members 103*s*, column supports, beams, cross-braces and the like. Furthermore, the upper substructure box assembly 103 is positioned on and attached to the lower substructure box assembly 102, which may also be made up of a plurality of similar column, beam, and cross-brace structural members 102*s*. In some embodiments, the lower substructure box assembly 102 may be made up of three separate lower substructure boxes, such as, for example, a front side lower box 102*a*, a back side lower box 102*b*, and a middle lower box 102*c*. Furthermore, the length of each of the three lower substructure boxes 102*a-c* may extend laterally across the lower substructure box assembly 102, that is, from the driller's side 112 of the substructure assembly 101 to the off-driller's side 113 (see, FIG. 1B). Some aspects of the lower substructure box assembly 102 and the lower substructure boxes 102*a-c* will be described further detail with respect to FIGS. 3A-3P below.

In certain embodiments, rig movement means 120 may include a plurality of separate rig movement apparatuses, each of which may be located proximate a respective corner of the substructure assembly 101 (two shown in the elevation/section view FIG. 1G; four shown in the plan/section view of FIG. 1F). Additionally, each of the illustrative rig movement apparatuses shown in FIG. 1G may include, for example, a skid foot 121 that is adapted to be moved laterally during rig movement, a rig raising apparatus 123 that is adapted to raise and lower the mobile drilling rig 100 during rig movement, and a skid foot movement apparatus 122 that is operatively coupled to the skid foot 121 and the substructure raising apparatus 123, and which is adapted to laterally move the skid foot 121 during rig movement. Furthermore, in at least one exemplary embodiment, rig movement means 120 (e.g., the various components of the plurality of rig movement apparatuses) may be actuated as outlined in U.S. patent application Ser. No. 13/863,680, referenced above.

Also as shown in FIG. 1G, the first BOP 131 is mounted on the wellhead 160 at the wellbore location 150, and equipment hoisting means 114, such as monorails 115*m* and hoisting apparatuses 115*h*, is attached to the upper substructure box assembly 103 and positioned above the first BOP 131. In order to facilitate the requisite work activities at each of the wellbore location 150*a*, 150, and 150*b*, such as work activities around the first BOP 131 during online drilling activities, platform extension structures 102*p* may be temporarily or removably attached to the lower substructure box assembly 102. Furthermore, FIG. 1G shows the second BOP 132 in position on equipment movement means 117, e.g., on one of the plurality of trolley carts 118*t*, where it may be moved back and forth cross the substructure assembly 101, e.g., along the rails 118*r*, between positions proximate each of the various wellbore locations 150*a*, 150, and 150*b*.

Figure 1H:
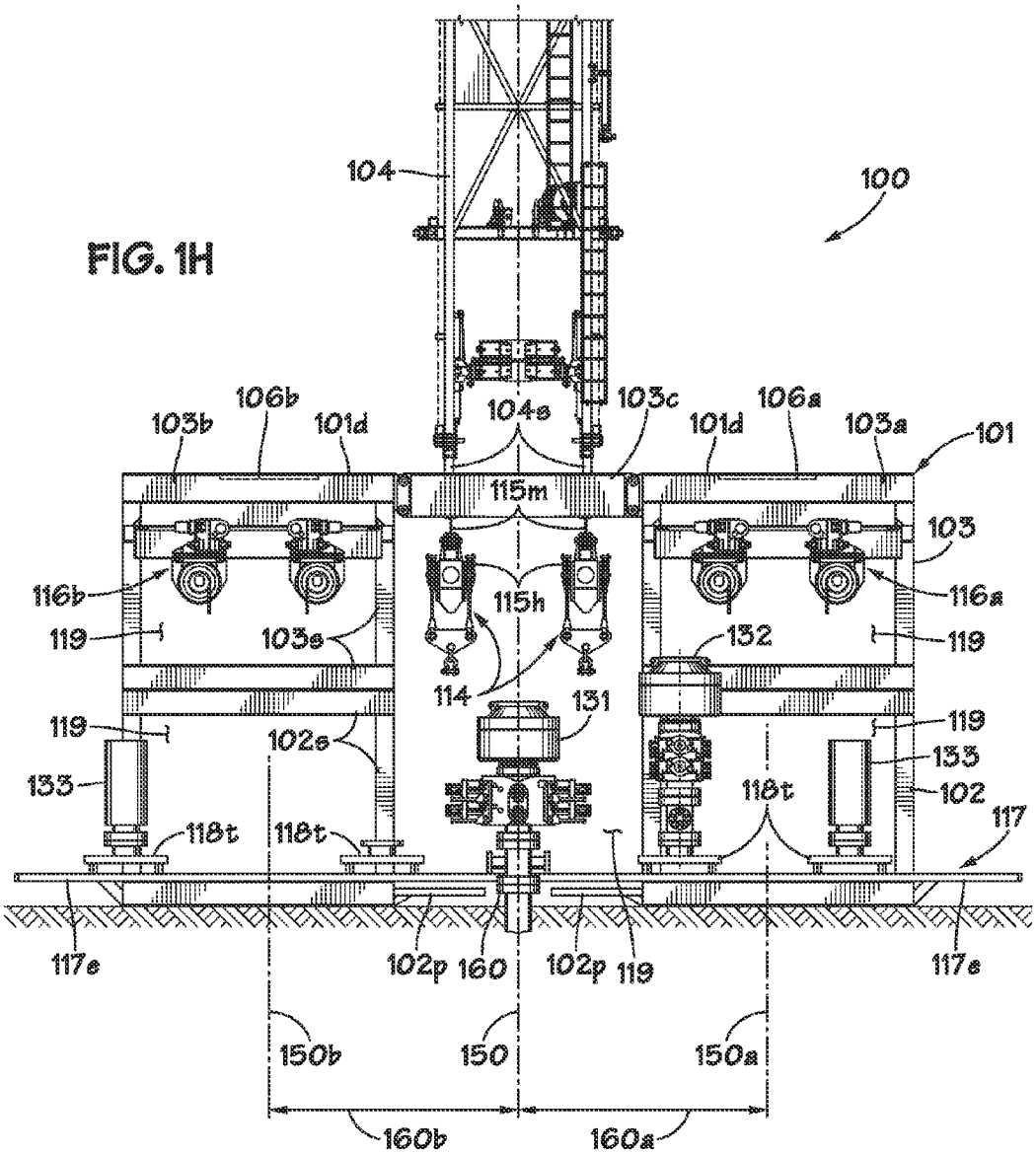
FIG. 1H is a close-up elevation/section view through the cellar area within the substructure assembly of the mobile drilling rig shown in FIGS. 1A and 1B taken along the section line "1H-1H" of FIG. 1B.

FIG. 1H is a close-up elevation/section view through the cellar area 119 within the substructure assembly 101 of the mobile drilling rig 100 shown in FIGS. 1A and 1B taken along the section line "1H-1H" of FIG. 1B, wherein only the lower portion of the drilling rig mast assembly 104 has been shown, for clarity. In some embodiments, the upper substructure box assembly 103 may include two separate upper substructure boxes 103*a/b*, for example, an off-driller's side upper box 103*a* and a driller's side upper box 103*b*. Additionally, a center floor section 103*c* may be positioned between and fixedly attached to each of the upper substructure boxes 103*a* and 103*b*, and the center floor section may be used to support equipment hoisting means 114, such as by attaching the monorail beams 115*m* to the bottom side thereof, as shown in FIG. 1H. Furthermore, the drilling rig mast assembly 104 may be positioned above and supported by the center floor section 103*c*. Additionally, the length of each of the upper substructure boxes 103*a* and 103*b* may extend in a transverse direction across the lower substructure boxes 102*a-c*, that is, from the V-door/front side 110 of the substructure assembly 101 to the drawworks/back side 111 (see, FIG. 1B), such that each of the upper substructure boxes 103*a/b* is substantially perpendicular to each of the lower substructure boxes 102*a-c*. Some additional aspects of the upper substructure box assembly 103 and the upper substructure boxes 103*a* and 103*b* will be described in further detail below in conjunction with FIGS. 3A-3P.

In the illustrative embodiment depicted in FIG. 1H, the second BOP 132 is positioned on equipment movement means 117, e.g., on one of the plurality of trolley cars 118*t*, so that the BOP 132 can be moved to one of the adjacent (off-line) wellbore locations 150*a*, 150*b*. Additionally, Christmas trees 133 (schematically depicted in FIG. 1H) may also be positioned on equipment movement means 117, e.g., other trolley cars 118*t*. As with the second BOP 132, the trolley cars 118*t* may thus be used to move each Christmas tree 133 along the wellbore location line 195 (see, FIGS. 1E-1F) for positioning on a wellhead 160 at a respective off-line wellbore location 150*a*, 150*b*, or after a respective Christmas tree 133 has been removed therefrom.

FIGS. 2A-2J illustrate various steps of an exemplary method that may be used to move pressure control equipment between a plurality of wellbore locations in a "leapfrog" fashion while a drilling rig is positioned above at least some of the wellbore locations. In some illustrative embodiments, such "leapfrog" movement of the pressure control equipment enables the drilling rig to simultaneously perform on-line operations—such as drilling a section of a borehole and running casing into the borehole section—on a main wellbore location while performing off-line operations—such as wellbore preparation and cementing casing—on one or more adjacent wellbore locations without moving the drilling rig.

It should be noted that, where appropriate, the reference numbers used in describing the various elements shown in FIGS. 2A-2J substantially correspond to the reference numbers used in describing the corresponding elements illustrated in FIGS. 1A-1H above, except that the leading numeral for has been changed from a "1" to a "2," as may be appropriate. For example, the substructure assembly "101" of FIGS. 1A-1H substantially corresponds to the substructure assembly "201" of FIGS. 2A-2J, equipment movement means "117" corresponds to equipment movement means "217," first BOP "131" corresponds first BOP "231," and so on. Accordingly, the reference number designations used to identify some elements of the presently disclosed subject matter may be illustrated in the FIGS. 2A-2J, but may not be fully or specifically described in the following disclosure. In those instances, it should be understood that the numbered elements shown in FIGS. 2A-2J which are not described in detail below substantially correspond with their similarly-numbered counterparts (i.e., other than a leading "2" vs. a leading "1") illustrated in FIGS. 1A-1H and described in the associated disclosure set forth above.

Figure 2A:
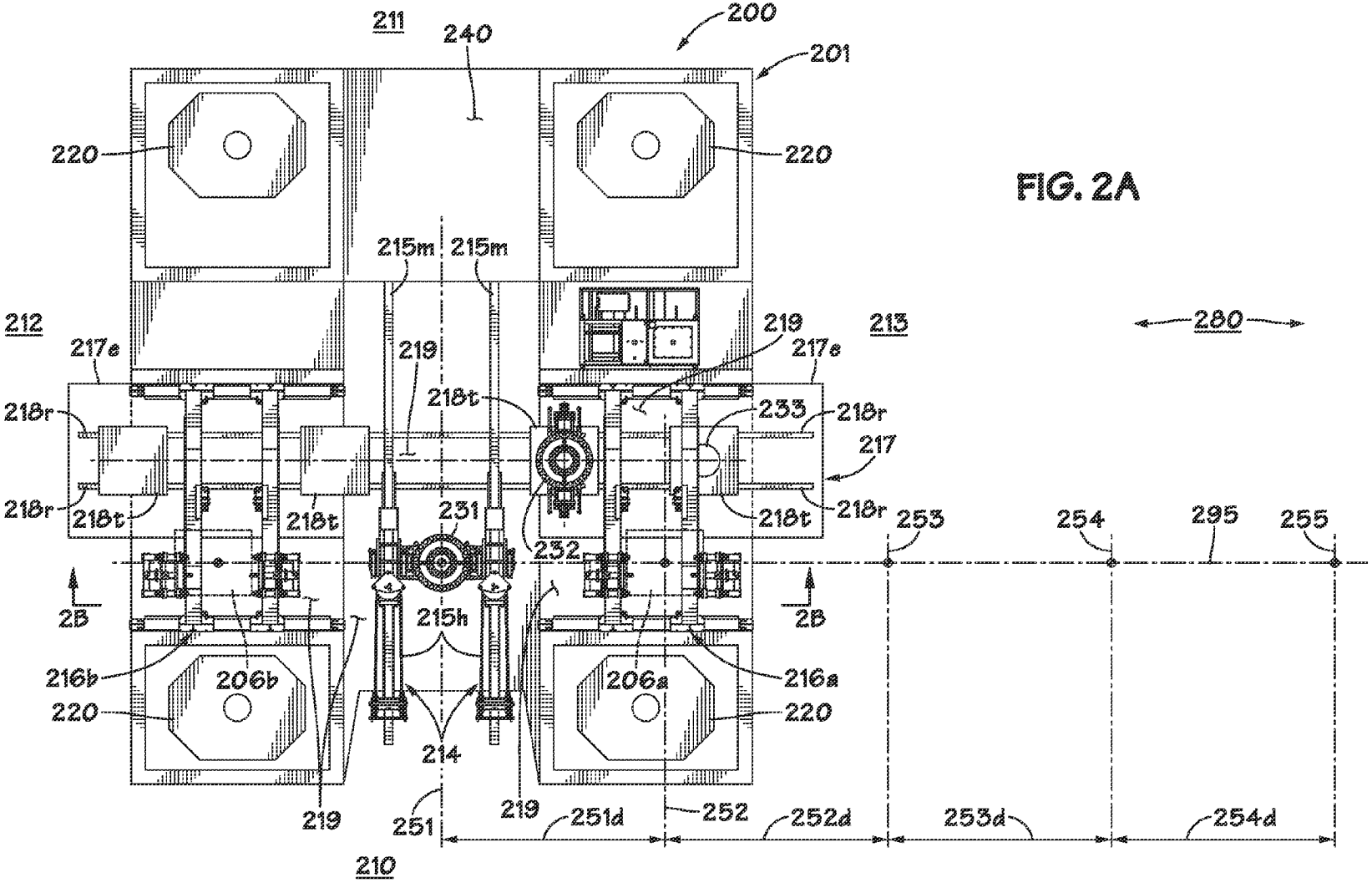
FIG. 2A is a plan view of the cellar area within a substructure assembly of an exemplary mobile drilling rig that is positioned above and adjacent to a plurality of wellbore locations of a pad drilling site.

FIG. 2A is a plan view of the cellar area 219 within a substructure assembly 201 of an exemplary mobile drilling rig 200 that is configured in substantially similar fashion to the mobile drilling rig 100 of FIGS. 1A-1H. As shown in FIG. 2A, the mobile drilling rig 200 is positioned on a pad drilling site 280 that includes a plurality of wellbore locations 251-255. In certain exemplary embodiments, each of the wellbore locations 251-255 may be substantially aligned along a wellbore location line 295. Furthermore, the nominal spacing between adjacent wellbore locations—i.e., the spacing 251*d* between wellbore locations 251 and 252, the spacing 252*d* between locations 252 and 253, the spacing 253*d* between locations 253 and 254, and the spacing 254*d* between locations 254 and 255—is generally substantially the same. In some embodiments, the nominal spacing 251*d*-254*d* may be in the range of approximately 3-5 meters (10-16 feet), although it should be appreciated that other spacing dimensions may also be used, depending on factors such as the size of the mobile drilling rig 200 and/or the desired drilling program and the like.

It should be appreciated that, as is discussed with respect to FIG. 1E above, the specific positions of the wellbore locations 251-255 may be subject to a wellbore location alignment tolerance relative to the line 295 as well as a spacing tolerance between wellbore locations. For example, in either case, the alignment and/or spacing tolerances may be approximately ±0.1 meters (4 inches) and the like. Additionally, it should be understood that the five wellbore locations 251-255 shown in FIG. 2A are exemplary only, as the pad drilling site 280 may include as many as 10, 20, 30, or even more total wellbore locations.

As shown in FIG. 2A, the mobile drilling rig 200 may include rig movement means 220 positioned proximate each respective corner of the substructure assembly 201. As noted with respect to the mobile drilling rig 100 of FIGS. 1A-1H, rig movement means 220 may be used for laterally moving the mobile drilling rig 200 along the wellbore location line 295 so as to position the mobile drilling rig 200 above additional wellbore locations for further rig operations. FIG. 2A further shows that the mobile drilling rig 200 is positioned directly above a first wellbore location 251, that is, wherein the drilling rig mast assembly 204 is positioned so that on-line operations, such as borehole drilling and/or running of casing, can be performed through the first BOP 231, which is positioned on a wellhead 261 at the first wellbore location 251 (see, FIG. 2B). Additionally, FIG. 2A shows that mobile drilling rig 200 is also positioned above a second wellbore location 252, such that the second wellbore location 252 is below and substantially aligned with the access hatch 206*a* in the off-driller's side upper box 203*a* of the substructure assembly 201.

In the exemplary mobile drilling rig 200 depicted in FIG. 2A, equipment movement means 217 is positioned adjacent to the first and second wellbore locations 251 and 252. Furthermore, equipment movement means 217 may be configured to move pressure control equipment, such as BOP's and/or Christmas trees, along a line that is substantially aligned with the wellbore location line 295. As noted above, equipment movement means 217 may include a pair of substantially parallel rails 218*r* on which a plurality of trolley cars 218*t* are movably mounted, and which are adapted for supporting and moving the pressure control equipment to and from positions proximate each of the wellbore locations.

In the rig activity phase illustrated in FIG. 2A, equipment hoisting means 214 is positioned above the first BOP 231 at the first wellbore location 251. In some embodiments, equipment hoisting means 214 may be used to initially position the first BOP 231 on the wellhead 261 at the first wellbore location 251 prior to performing on-line drilling operations the first wellbore location 251. Additionally, equipment hoisting means 214 may also be used to lift the first BOP 231 off of the wellbore location 251 and move the first BOP 231 into the workshop area 240 of the substructure assembly 201, as may be required for emergency shut-down and/or maintenance situations. Furthermore, in the embodiment depicted in FIG. 2A, first equipment positioning means 216*a* is positioned substantially above the second wellbore location 252, where it may be used, when required, to lift a specific piece of pressure control equipment, such as the second BOP 232, from equipment movement means 217, e.g., from a respective trolley car 218*t*, move the second BOP 232 above the second wellbore location 252, and position it on the wellhead 262 at the second wellbore location 252.

Additionally, in those applications where each of the wellbore locations 251-255 may have been previously spudded and a conductor casing set, a Christmas tree 233 (see, FIG. 2B) or other pressure control equipment may have been mounted on the respective wellheads 261-265 (see, FIG. 2B) of each wellbore location 251-255 before the mobile drilling rig 200 is moved in to drill each wellbore to TD. In such cases, first equipment positioning means 216*a* may also be used to lift and remove the Christmas tree 233 from above the second wellbore location 252 and move the Christmas tree 233 to equipment movement means 217, e.g., to a respective trolley car 218*t*. Furthermore, equipment hoisting means 214 may be used to remove a Christmas tree 233 (not shown in FIG. 2B) from the first wellbore location 251 and move the Christmas tree 233 into the equipment workshop area 240 prior to positioning the first BOP 231 on the first wellbore location 251.

As shown in FIG. 2A, second equipment positioning means 216*b* is positioned in the driller's side upper box 203*b* and substantially below the access hatch 206*b*. Once the mobile drilling rig 200 has been moved along the wellbore location line 295 and positioned above an additional wellbore location, such as the third wellbore location 253 (see, FIG. 2D), second equipment positioning means 216*b* may be used to perform similar lifting, moving, and positioning activities as is described with respect to first equipment positioning means 216*a* above.

FIGS. 2B-2J each illustrate an elevation/section view from the V-door/front side 210 of the mobile drilling rig 200 shown in FIG. 2A taken along the section line "2B-2B" during the various disclosed exemplary steps of simultaneously performing wellbore preparation, drilling, and completion operations on at least some of the plurality of wellbore locations 251-255 of the pad drilling site 280. For clarity of the other depicted elements, windwalls (see, FIG. 1D) and rig movement means 220 (see, FIG. 2A) have not been depicted in FIGS. 2B-2J.

Figure 2B:
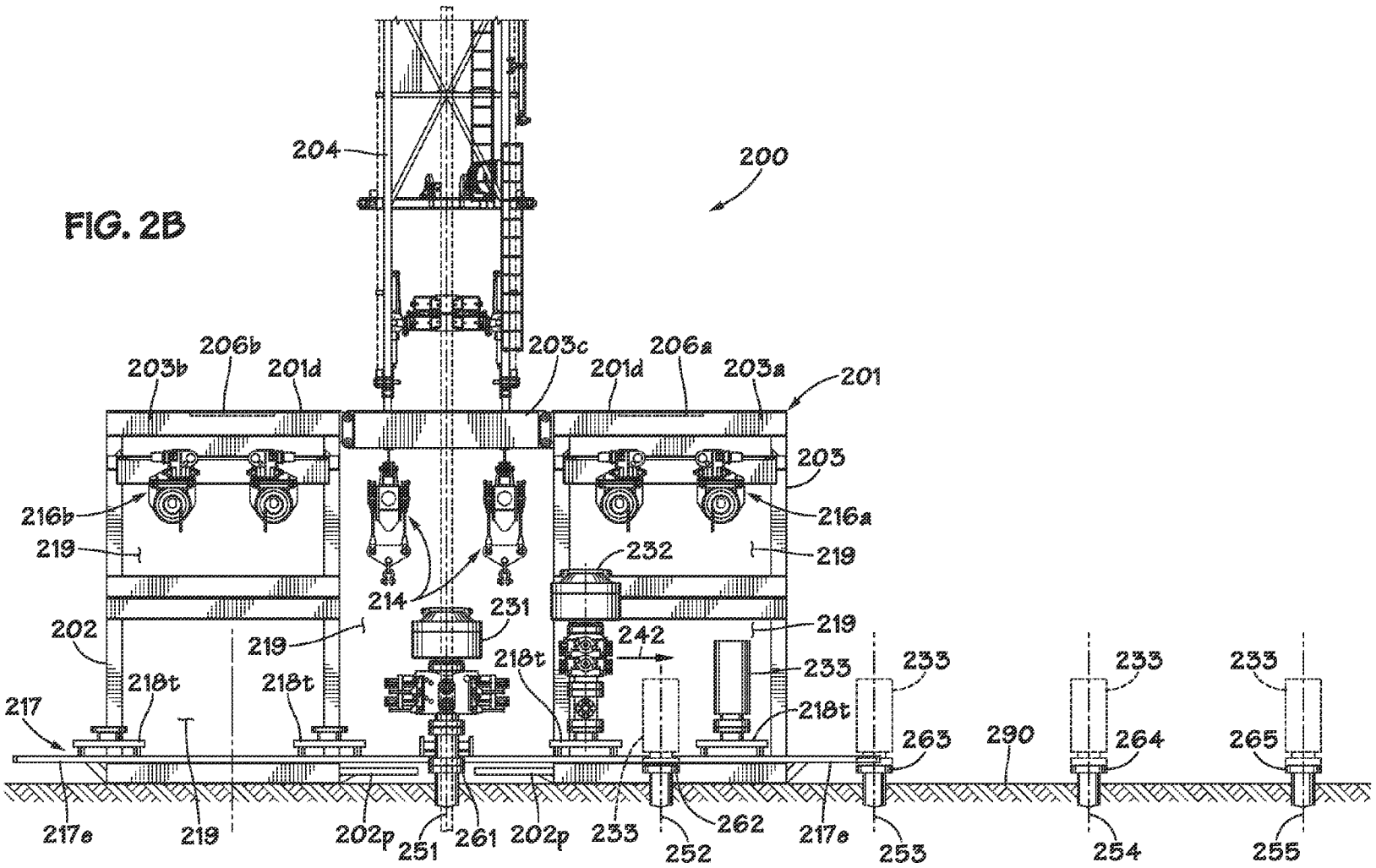

FIG. 2B illustrates an early step in the "leapfrog" movement of pressure control equipment between the various wellbore locations 251-255. As shown in FIG. 2B, the first BOP 231 has been mounted on the wellhead 261 at the first wellbore location 251, and on-line operations (e.g., drilling, etc.) are being performed through the first BOP 231 using the drilling rig mast assembly 204 (only partially shown in FIGS. 2B-2J). In one embodiment, while the on-line operations are being performed on the first wellbore location 251, equipment movement means 217 may be used to move (directional arrow 242) the second BOP 232 to a position proximate the second wellbore location 252, e.g., by moving the second BOP 232 with a respective trolley car 218*t* along the rails 218*r*.

As noted above, if pressure control equipment, such as a Christmas tree 233, has been previously mounted on the wellhead 262 at the second wellbore location 252, first equipment positioning means 216*a* must initially be used to lift and remove the Christmas tree 233 from above the second wellbore location 252 and move the Christmas tree to equipment movement means 217, e.g., to a respective trolley car 218*t*. Thereafter, first equipment positioning means 216*a* may be used to position the second BOP 232 on the wellhead 262 at the second wellbore location 252. Additionally, if a Christmas tree 233 has been removed earlier from the second wellbore location 252, equipment movement means 217 may then be used to move the Christmas tree 233—e.g., along the rails 218*r*—until the Christmas tree 233 is positioned substantially below equipment hoisting means 214. Thereafter, equipment hoisting means 214 may be used to lift the Christmas tree 233 from equipment movement means 217, e.g., from the trolley car 218*t*, and move the Christmas tree 233 into the equipment workshop area 240 for maintenance, repair, testing, and the like.

Figure 2C:
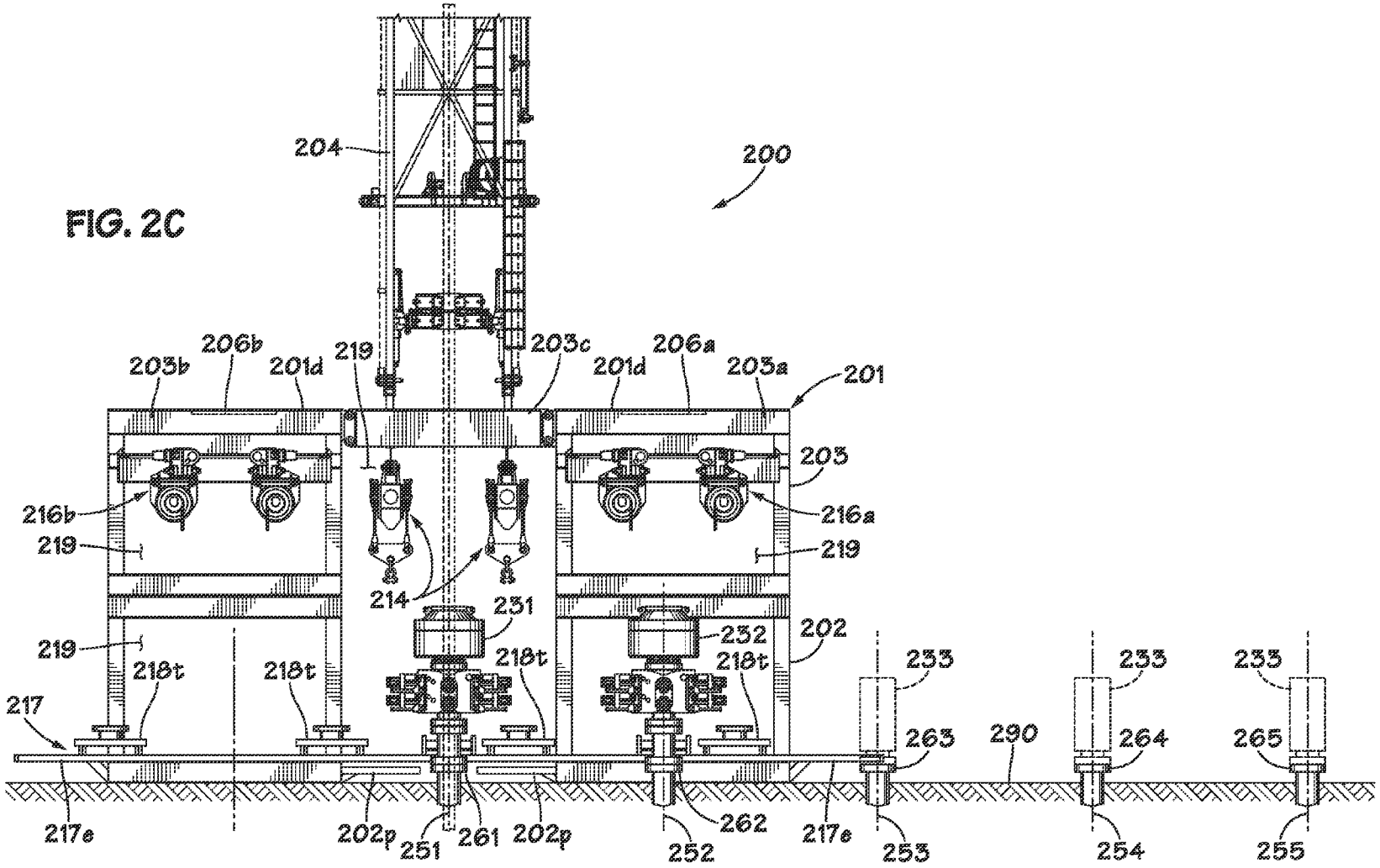

FIG. 2C depicts the elevation/section view of FIG. 2B after the above-described steps have been completed. As shown in FIG. 2C, in one exemplary embodiment, the second BOP 232 may be mounted on the wellhead 262 at the second wellbore location 252 while on-line operations, such as drilling and/or running casing and the like, are performed through the first BOP 231 at the first wellbore location 251. For example, in certain embodiments, first equipment positioning means 216*a* may be used to lift second BOP 232 from equipment movement means 217 (e.g., from the trolley cart 218*t*), and thereafter move and position the BOP 232 on the wellhead 262. Off-line operations, such as testing the second BOP 232 and/or otherwise preparing the wellbore for drilling activities and the like, may then be performed on the second wellbore location 252. In this way, the "flat time" that is often associated with such testing and well preparation activities may be substantially avoided—or at least reduced—because in at least some embodiments, these activities may be performed simultaneously on the second wellbore location 252 while on-line operations are being performed on the first wellbore location 251. On-line operations are thus continued on the first wellbore location 251 until the well section is drilled to the desired depth and casing has been run into the borehole in preparation for cementing the section.

Figure 2D:
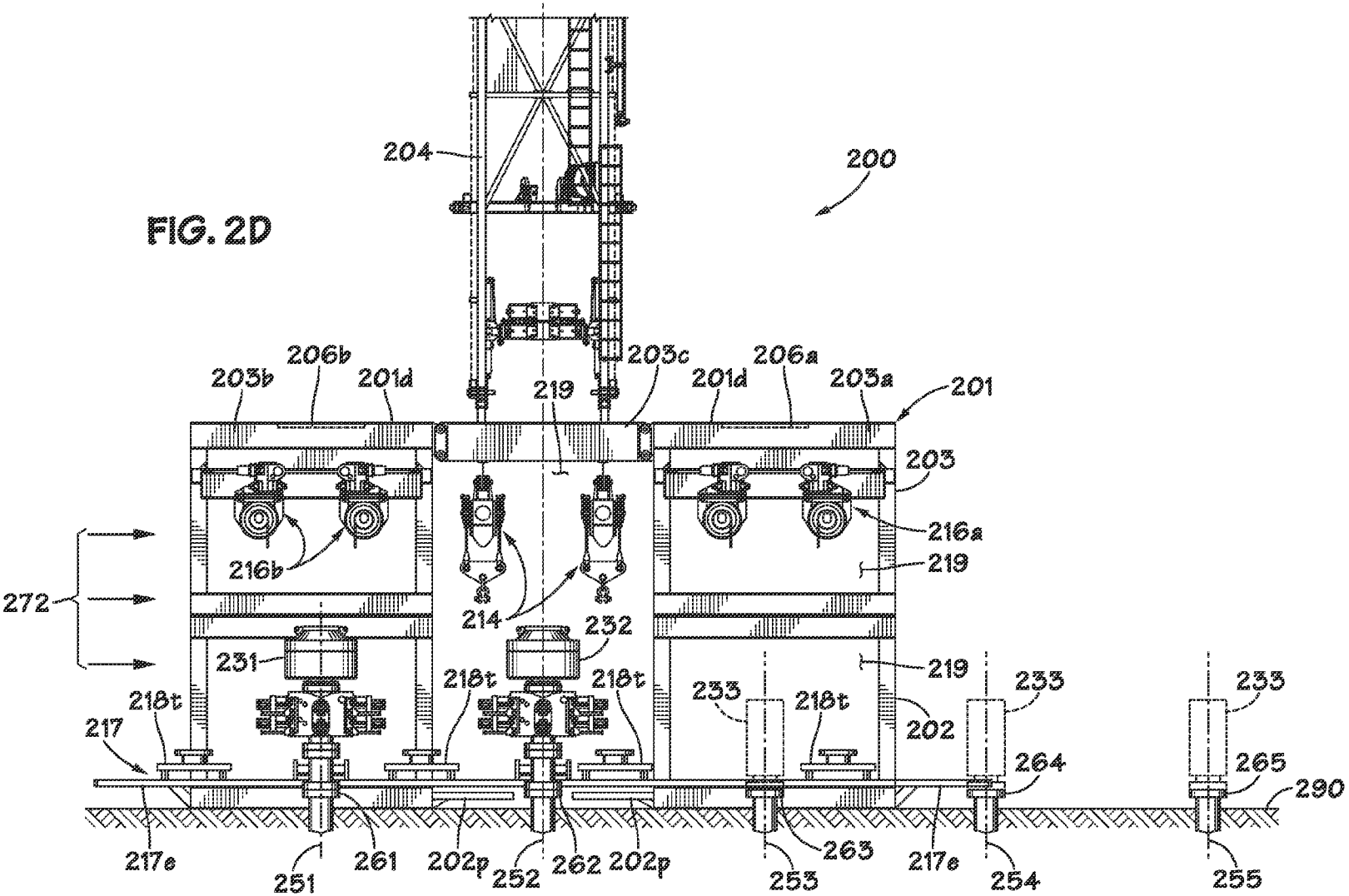

FIG. 2D illustrates a subsequent step after completion of the sequence described in conjunction with FIGS. 2B-2C above, that is, after the on-line operations on the first wellbore location 251 have been completed. As shown in FIG. 2D, rig movement means 220 (not shown in FIG. 2D, for clarity) have been used to move (directional arrows 272) the mobile drilling rig 200 across the ground 290 of the pad drilling site 285 and down the line 295 of wellbore locations until the off-driller's side 213 of the substructure assembly 201 has been moved above the third wellbore location 253. In this position, the drilling rig mast assembly 204 is positioned above and substantially aligned with the second wellbore location 252 so that on-line operations (drilling, running casing, etc.) may be performed on the second wellbore location 252 through the second BOP 232.

Generally, the access hatch 206*b* in the drill floor 201*d* of the driller's side upper box 203*b* may now be substantially aligned with the first wellbore location 251 and the first BOP 231 positioned thereabove, as is shown in FIG. 2D. When aligned in this manner, off-line operations, such as cementing the wellbore casing in place, may be performed on the first wellbore location 251, e.g., through the access hatch 206*b* and the first BOP 231 as will be further described with respect to FIG. 2E below. Additionally, it should be noted that the access hatch 206*a* in the off-driller's side upper box 203*a* may also be substantially aligned with the third wellbore location 253, where further off-line operations, such as wellbore preparation and the like, may now be performed.

In certain embodiments, such as when platform extension structures 202*p* are removably attached to the lower substructure box assembly 202 so as to facilitate work activities around the various wellbores in the cellar area 219 (see, FIG. 2A), the platform extension structures 202*p* will typically be temporarily removed prior to moving the mobile drilling rig 200 above the third wellbore location 253. After the mobile drilling rig 200 has been re-positioned as described above, the platform extension structures 202*p* may be replaced around each of the wellbore locations 251-253.

Figure 2E:
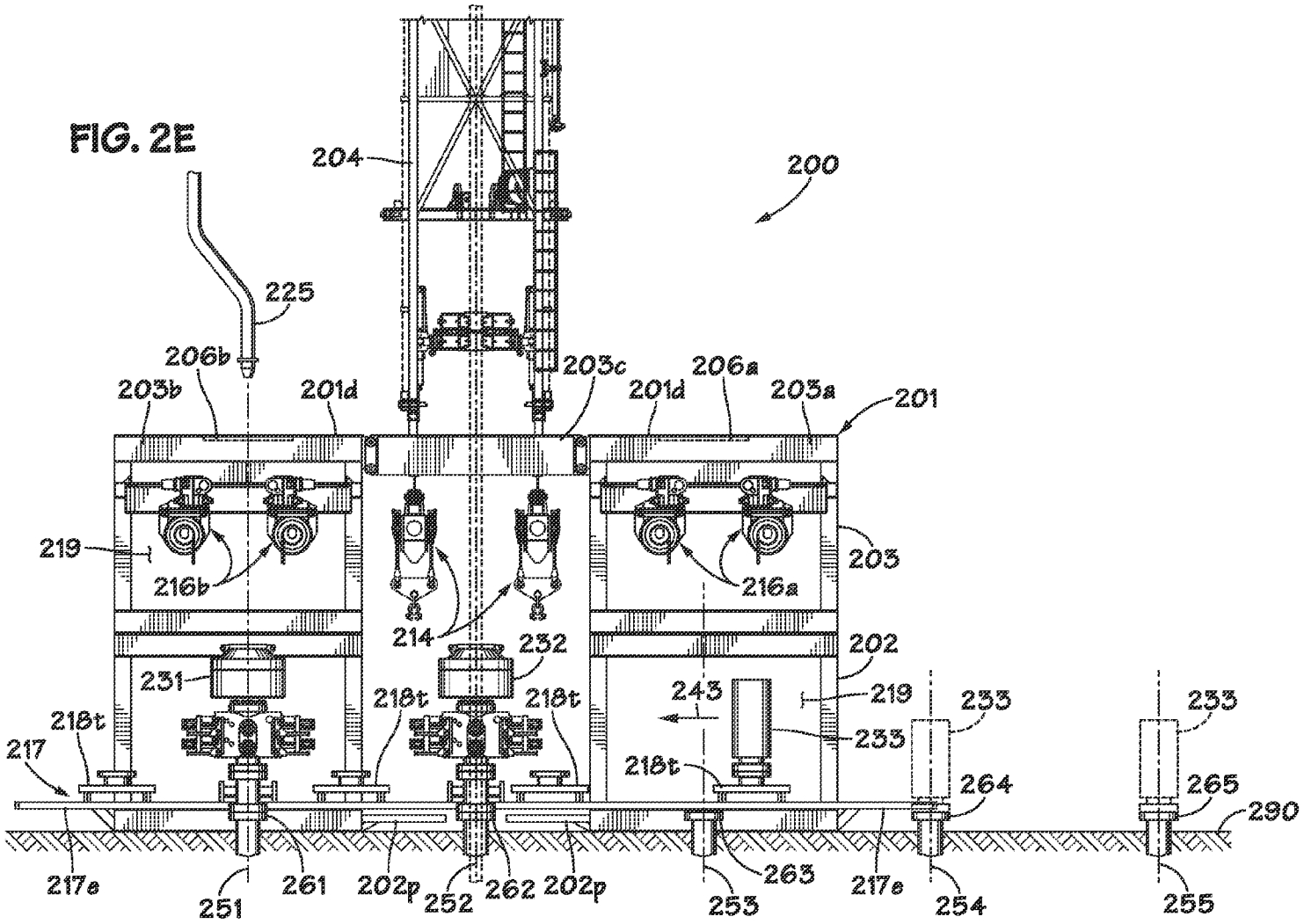

In a further illustrative step in the rig activity sequence as shown in FIG. 2E, on-line drilling operations may begin on the second wellbore location 252 using the drilling rig mast assembly 204. Furthermore, in order to increase the overall operational efficiency of the mobile drilling rig 200, off-line operations, such as off-line cementing and/or wellbore preparation operations, may also commence on either or both of the adjacent first and third wellbore locations 251 and 253. In this way, the "flat time" that generally occurs when such operations are performed sequentially in an on-line manner on a single wellbore location—that is, on the wellbore location that is positioned directly below the drilling rig mast—may be avoided, or at least substantially reduced.

In one embodiment, as shown in FIG. 2E, while an on-line drilling operation is being performed on the second wellbore location 252, an off-line cementing operation may be performed on the first wellbore location 251 so as to cement in place the casing that was run into the borehole of the first wellbore location 251 during the previous on-line operations. See, FIGS. 2B-2C. In some embodiments, a cement stinger 225 (schematically depicted in FIG. 2E) may be brought into position above the drill floor 201*d* of the driller's side upper box 203*b* and lowered down through the access hatch 206*b* (which may be substantially aligned with the first wellbore location 251) to the first BOP 231. Thereafter, the cement stinger 225 may be operatively coupled to the first BOP 231 and cement pumped into the borehole of the first wellbore location 251 through the first BOP 231 in a manner known to those skilled in the art. In this way, the casing at the first wellbore location 251 can be set in place off-line while the borehole of the second wellbore location 252 is being drilled on-line.

Initial off-line wellbore preparation activities may also commence at the third wellbore location 253 while either or both of the first and second wellbore locations 251, 252 are being worked as described above. For example, in at least some embodiments, such as when pressure control equipment, e.g., a Christmas tree 233, has been previously positioned above the third wellbore location 253, the off-line wellbore preparation activities may include operating first equipment positioning means 216*a* to remove the Christmas tree 233 from the wellhead 263 at the third wellbore location 253. Thereafter, first equipment positioning means 216*a* may be used to position the Christmas tree 233 on equipment movement means 217 (e.g., on a trolley cart 218*t*), which may then be used together with equipment hoisting means 214 to move (directional arrow 243) the Christmas tree 233 into the equipment workshop area 240, is previously described with respect to FIG. 2B above.

Figure 2F:
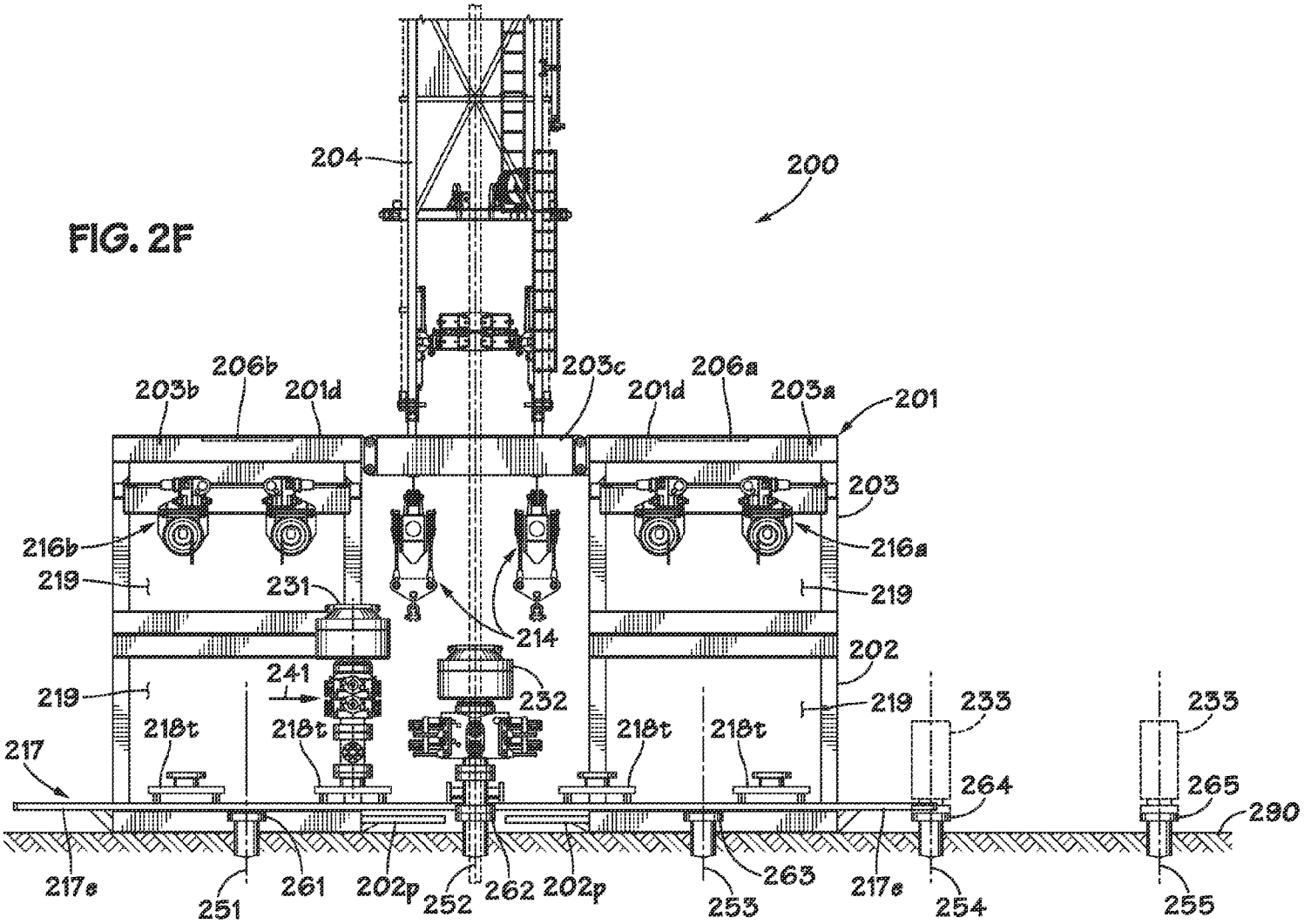

Once the off-line cementing operation has been completed at the first wellbore location 251, the first BOP 231 may then be removed from the wellhead 261 at the first wellbore location 251 and positioned on equipment movement means 217 (e.g., a trolley cart 218*t*) using second equipment positioning means 216*b*, e.g., a bridge crane, as shown in FIG. 2F. In some exemplary embodiments, equipment movement means 217 may then be used to move (directional arrows 241) the first BOP 231 to a position proximate the third wellbore location 253 (see, FIG. 2G), i.e., by "leapfrogging" the second BOP 232 on the second wellbore location 252, where on-line drilling operations may continue. In other embodiments, the first BOP 231 may initially be moved by equipment movement means 217 (e.g., by moving the BOP 231 on the trolley cart 218*t* along the rails 218*r*) to a position below equipment hoisting means 214, which may then be used to lift and move the first BOP 231 into the equipment workshop area 240 for maintenance, repair, testing, and the like, as may be required (see, FIG. 2A). Once the requisite maintenance operations have been performed on the first BOP 231, it may be removed from the equipment workshop area 240 using equipment hoisting means 214, and thereafter moved into position proximate the third wellbore location 253 using equipment movement means 217, thereby "leapfrogging" the second wellbore location 252 as described above.

Figure 2G:
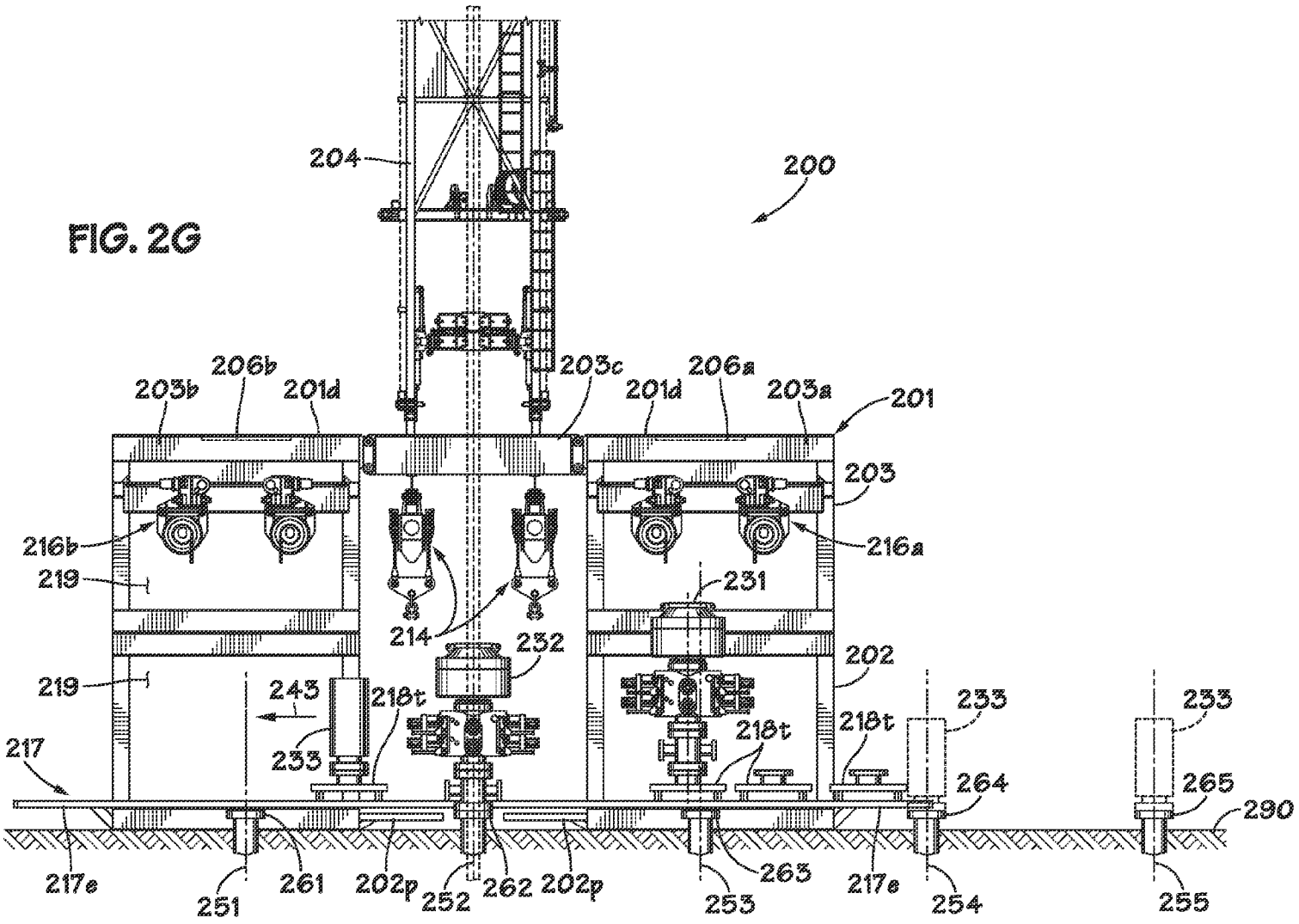
Figure 2H:
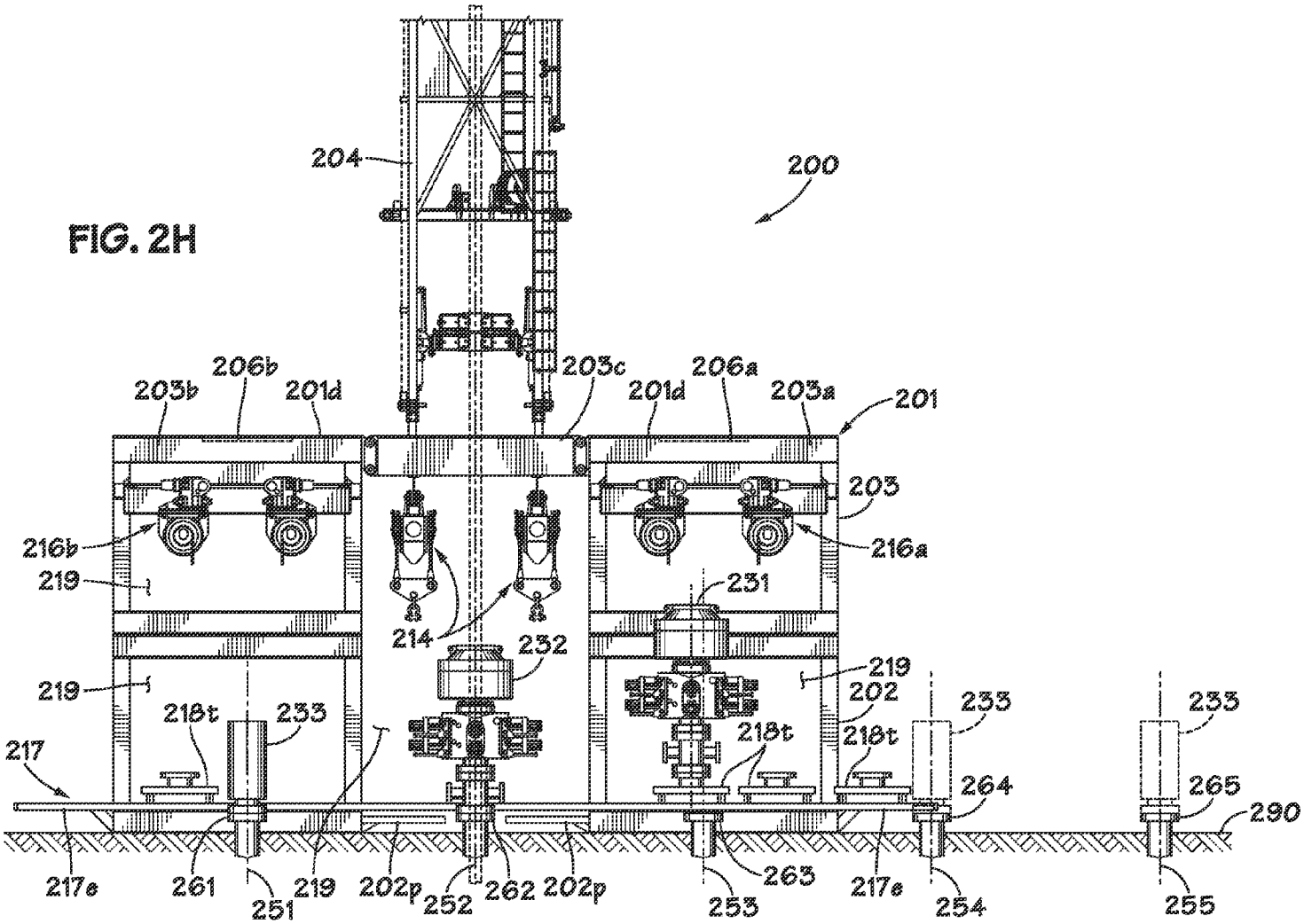
Figure 21:
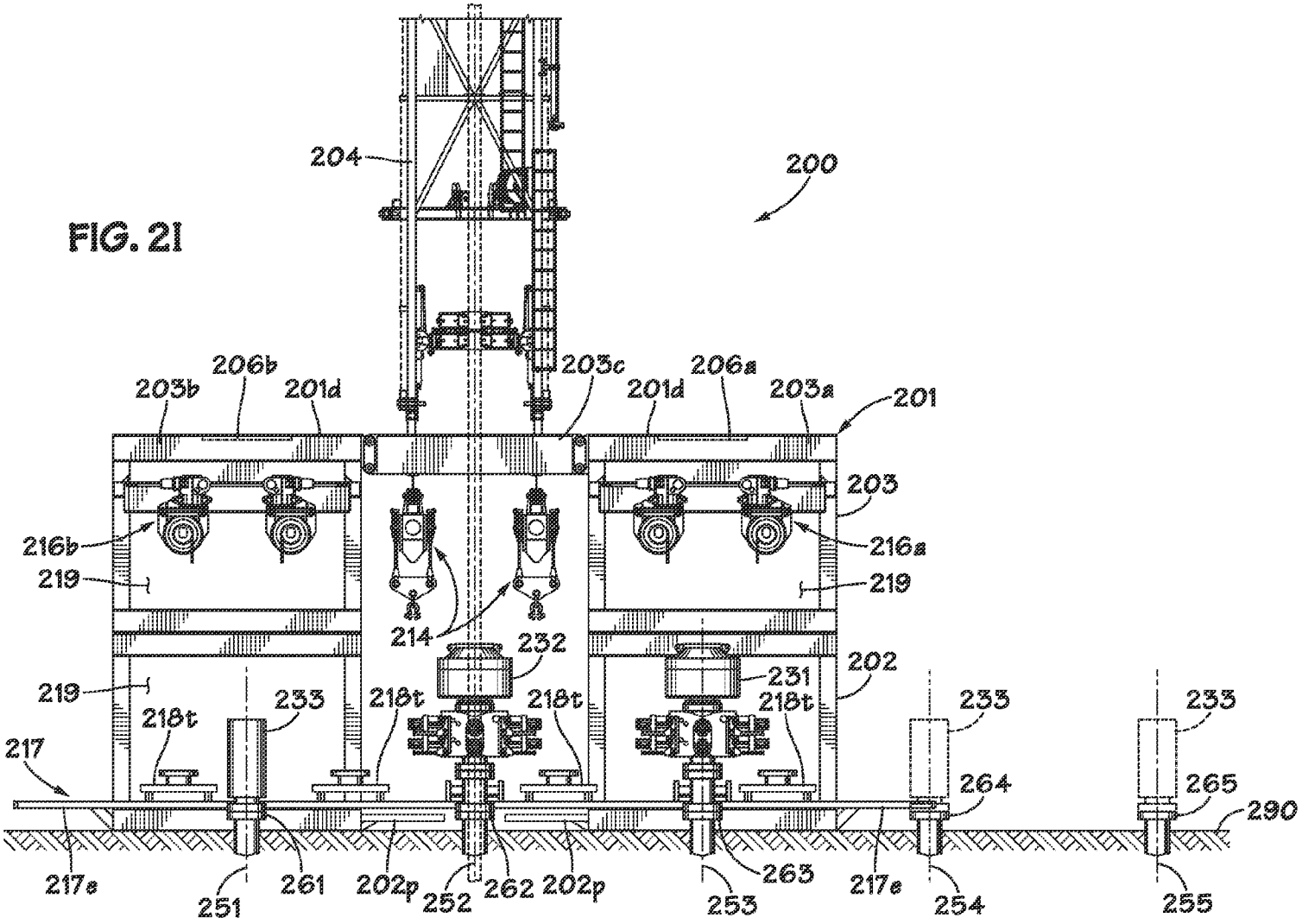

In some illustrative embodiments, a Christmas tree 233 may then be moved from the equipment workshop area 240 using equipment hoisting means 214 (see, FIG. 2A), where it can then be positioned on equipment movement means 217 (e.g., a trolley cart 218*t*). Thereafter, as shown in FIG. 2G, the Christmas tree may be moved (directional arrows 243) to a position proximate the first wellbore location 251 (e.g., by moving the trolley cart 218*t* along the rails 218*r*). Once in this position, second equipment positioning means 216*b* may then be used to position the Christmas tree 233 on the wellhead 261 at the first wellbore location 251, as shown in FIG. 2H. In some embodiments, such as when additional wellbore sections remain to be drilled and completed, the Christmas tree 233 may only be temporarily positioned on the first wellbore location 251 until the mobile drilling rig 200 is re-positioned above the first wellbore location 251 at a later time so as to drill the next wellbore section, as may be required. In other embodiments, such as when the borehole has been drilled to TD and fully completed, the Christmas tree 233 may remain permanently in this position on the first wellbore location 251 while waiting for production to commence.

FIG. 2I illustrates a further step in the rig activity sequence, after the first BOP 231 has "leapfrogged" the second BOP 232 on the second wellbore location 252 and been positioned on the third wellbore location 253 in preparation for on-line drilling operations once the mobile drilling rig 200 has been re-positioned directly above the third wellbore location 253. As noted with respect to FIG. 2C above, first equipment positioning means 216*a* may be used to remove the first BOP 231 from equipment movement means 217 (e.g., from the trolley cart 218*t*) and position the BOP 231 on the wellhead 263 at the third wellbore location 253. Furthermore, as shown in FIG. 2I, on-line operations, e.g., drilling and/or running casing, may continue through the second BOP 232 on the second wellbore location 252 while the first BOP 231 is being positioned on the third wellbore location 253, thus substantially avoid the "flat time" that may often be associated with on-line wellbore preparation activities, such as BOP positioning and testing, and the like.

As will be appreciated by those of ordinary skill after a complete reading of the present disclosure, at least some of the steps shown in FIGS. 2E-2I above may be performed in a different sequence than that which is described without substantially affecting the overall work flow and efficiency of the activities described. For example, the Christmas tree 233 that will eventually be positioned on the first wellbore location 251 after off-line cementing activities have been completed may be brought out from the equipment workshop area 240 at substantially any time during the described sequence, e.g., before off-line cementing commence, after off-line cementing has been completed but before the first BOP 231 has been removed from the first wellbore location 251, after the first BOP 231 has been mounted on the third wellbore location 253, etc. Accordingly, it should be appreciated that, in order to reduce the overall rig "flat time" described above, it is only necessary that such ancillary activities surrounding the off-line operations be performed while the primary on-line operations—e.g., drilling and/or running casing—are being simultaneously performed.

Figure 2J:
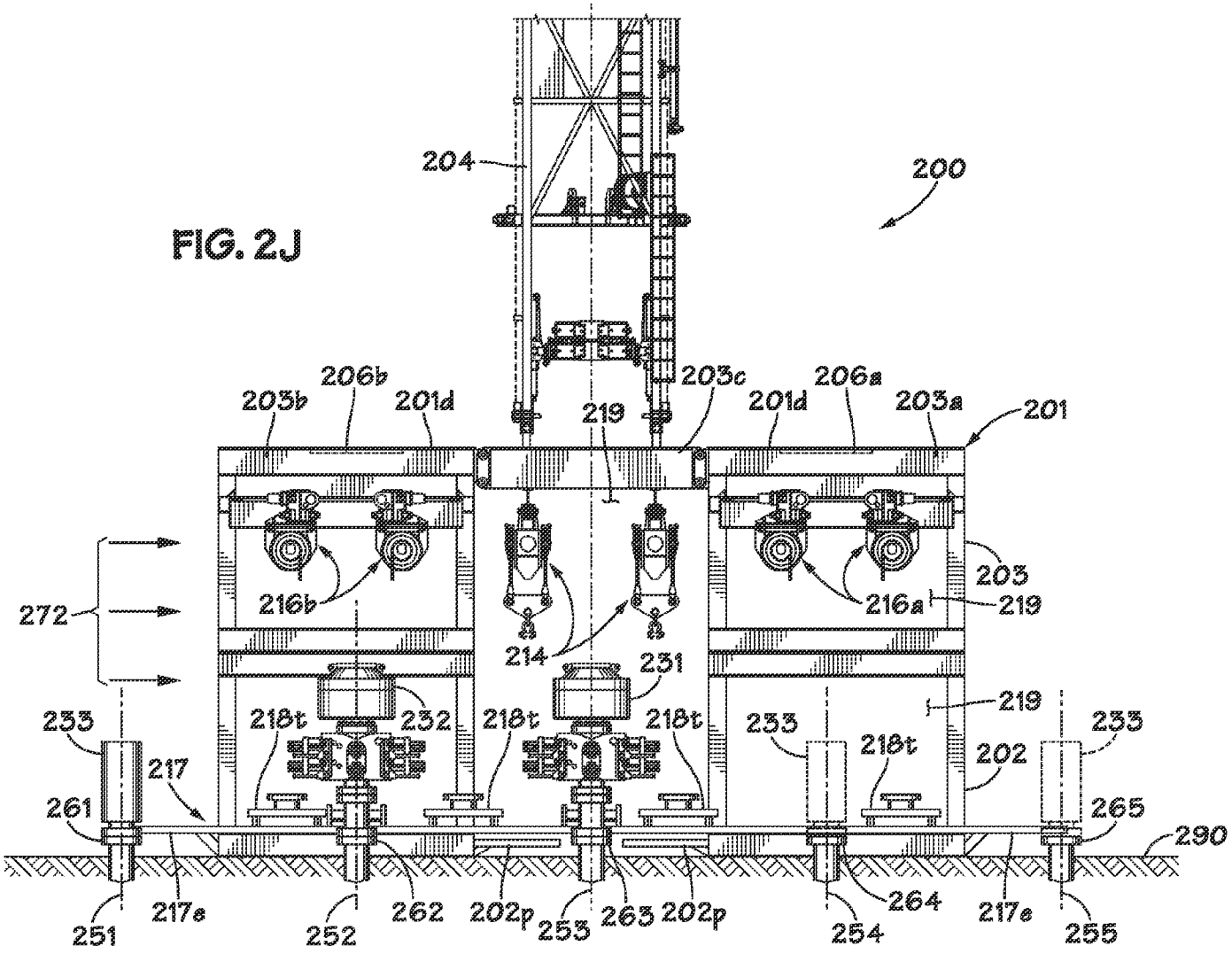

FIG. 2J shows a subsequent step after completion of the sequence of rig and equipment movement activities shown in FIGS. 2E-2I and described above, that is, after the on-line drilling and casing running operations on the second wellbore location 252 have been completed. As shown in FIG. 2J, rig movement means 220 (not shown in FIG. 2J, for clarity) have been used to move (directional arrows 272) the mobile drilling rig 200 across the ground 290 of the pad drilling site 285 and further down the line 295 of wellbore locations until the off-driller's side 213 of the substructure assembly 201 has been moved above the fourth wellbore location 254. In this position, the drilling rig mast assembly 204 is positioned above and substantially aligned with the third wellbore location 253 so that on-line operations (drilling, running casing, etc.) may be performed on the second wellbore location 252 through the second BOP 232.

As shown in FIG. 2J, the access hatch 206*b* in the drill floor 201*d* of the driller's side upper box 203*b* may now be substantially aligned with the second wellbore location 252 and the second BOP 232 positioned thereabove. Accordingly, off-line cementing operations may now be performed on the second wellbore location 252, e.g., through the access hatch 206*b* and the second BOP 232, as is further described with respect to FIG. 2E above. Additionally, it should be noted that the access hatch 206*a* in the off-driller's side upper box 203*a* may now be substantially aligned with the forth wellbore location 254, where further off-line operations, such as wellbore preparation and the like, may now be performed.

In viewing the configuration illustrated FIG. 2J, it should be appreciated that the first and second BOP's 231 and 232 are similarly positioned relative to the drilling rig mast assembly 204 as is shown in FIG. 2D above, except that their respective positions have now been reversed due to the "leapfrogging" movement of the BOP's described with respect to FIGS. 2E-2I above. More specifically, the first BOP 231 positioned on the third wellbore location 253 is now in the on-line drilling position (i.e., directly below and substantially aligned with the drilling rig mast assembly 204), whereas the second BOP 232 positioned on the second wellbore location 252 is now in the off-line cementing position (i.e., below and substantially aligned with the access hatch 206*b* in the driller's side upper box 203*b*. Accordingly, once the off-line cementing operation has been completed on the second wellbore location 252 in the manner described with respect to FIG. 2E above, BOP "leapfrogging" operations may thereafter continue as shown in FIGS. 2F-2I in order to "leapfrog" the second BOP 232 past the first BOP 231 and onto the fourth wellbore location 254.

It should be appreciated that each of the various on-line and off-line rig operations and BOP "leapfrogging" steps shown in FIGS. 2E-2J may be repeated in similar fashion until all of the wellbore locations positioned along the wellbore location line 295 (e.g., wellbore locations 251-255, or any further wellbore locations as may be required) have been prepared, the respective sections have been drilled and cased, and the respective casings have been cemented in place. Thereafter, once the cementing operation has been completed on the last wellbore location, such as the wellbore location 255, the movement direction of the mobile drilling rig 200 may be reversed—that is, the rig 200 may be moved in the opposite direction—so that additional rig operations may be performed in order to drill the next wellbore section at each respective wellbore location 251-255. As such, during the "reversed" movement of the mobile drilling rig 200, off-line wellbore preparation activities will be performed using second equipment positioning means 216*b* below the access hatch 206*b* in the driller's side upper box 203*b*, whereas off-line cementing operations will be performed using first equipment positioning means 216*a* below the access hatch 206*a* in the off-driller's side upper box 203*a*. Otherwise, all rig movement and BOP "leapfrogging" operations will be performed in substantially similar fashion as described with respect to FIGS. 2B-2J above, except that rig and equipment movements will be in the opposite direction.

Figure 3A:
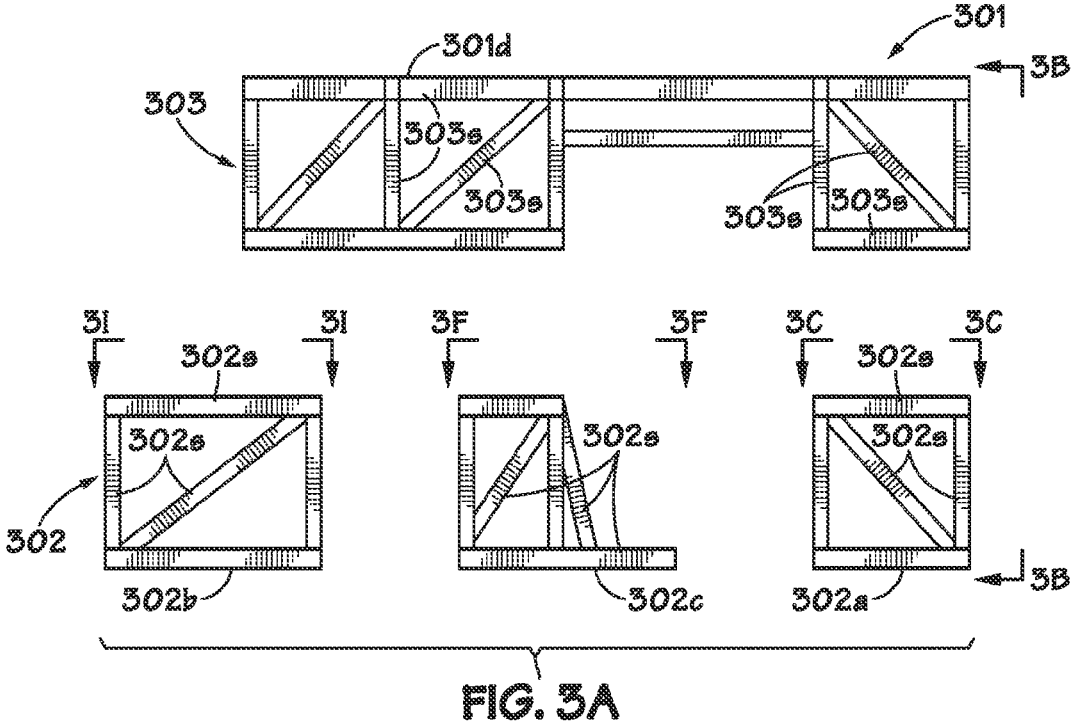
FIG. 3A is an exploded side elevation view of a substructure assembly of a mobile drilling rig in accordance with one illustrative embodiment of the present disclosure when viewed from the driller's side of the substructure assembly.
Figure 3B:
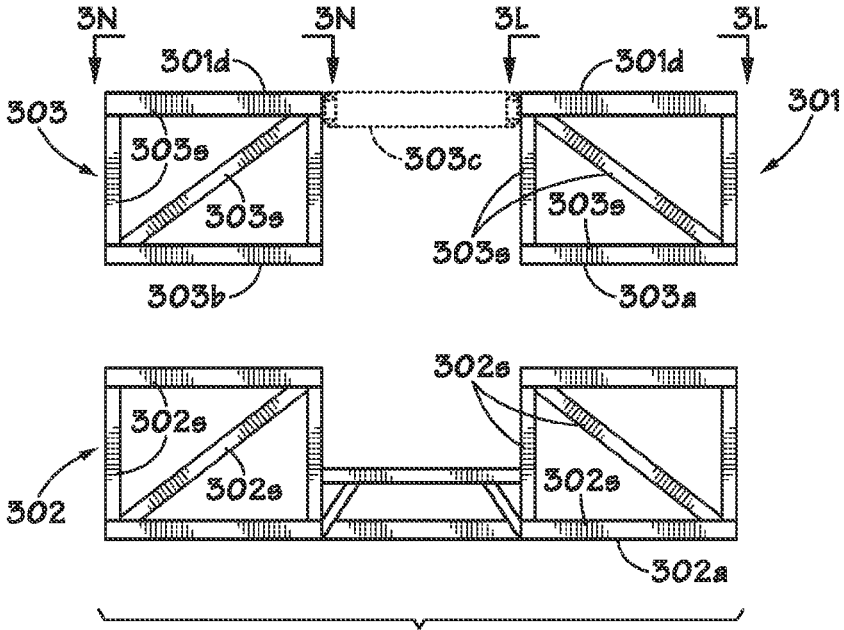
FIG. 3B is an exploded end elevation view of the substructure assembly of FIG. 3A when viewed from the V-door side, or front side, of the substructure assembly.
Figure 3M:
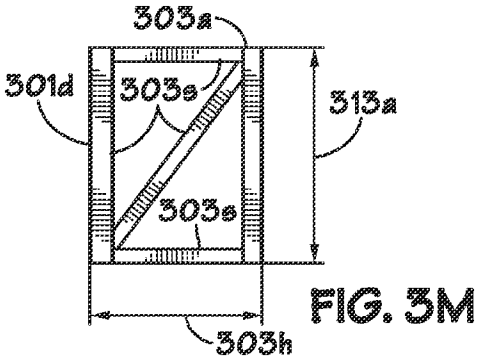
FIGS. 3L-3P are plan, side elevation, and end elevation views of driller's side and off-driller's side upper boxes of an upper substructure box assembly of the substructure assembly shown in FIGS. 3A-3B.
Figure 3O:
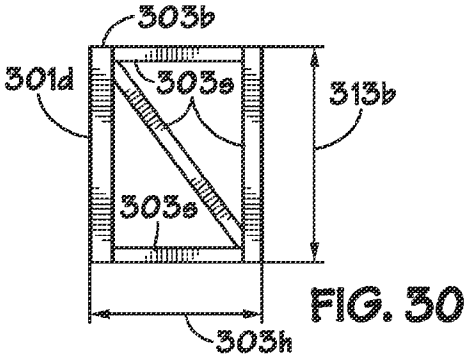
Figure 3L:
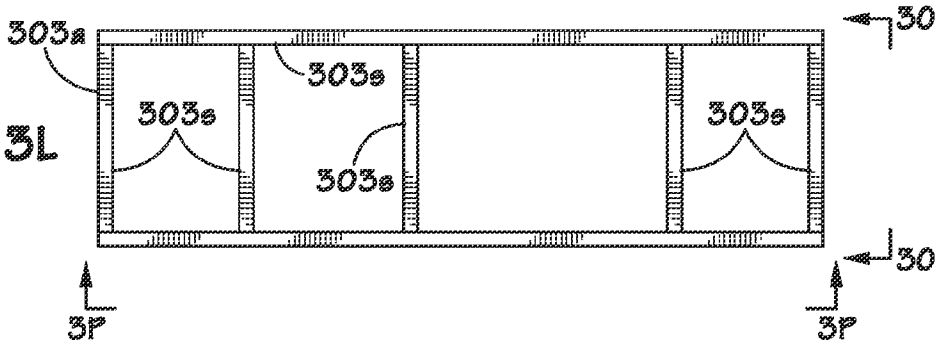
Figure 3N:
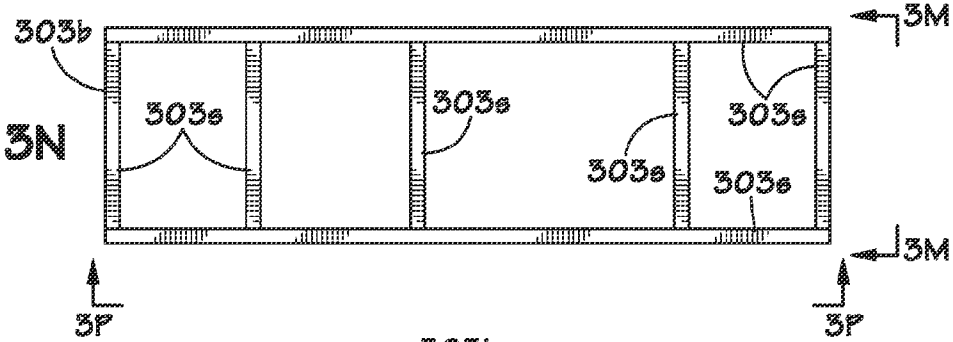
Figure 3P:
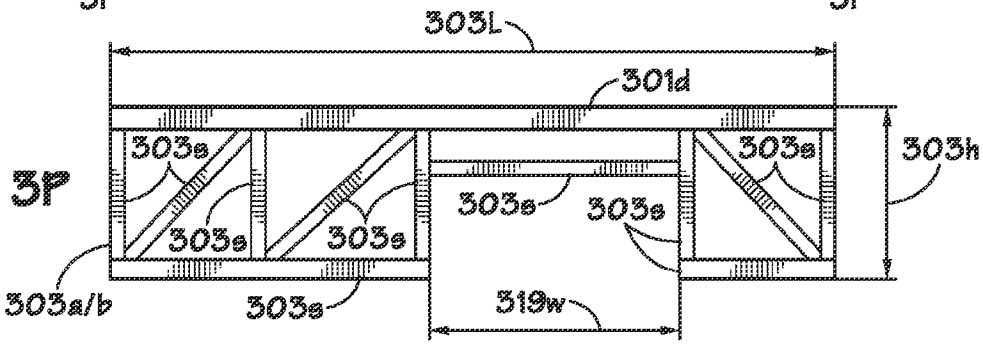

It should be noted that, where appropriate, the reference numbers used in describing the various elements shown in FIGS. 3A-3P substantially correspond to the reference numbers used in describing the corresponding elements illustrated in FIGS. 1A-1H and FIGS. 2A-2J above, except that the leading numeral for has been changed from a "1" or a "2" to a "3," as may be appropriate. For example, the substructure assemblies "101" and "201" of FIGS. 1A-1H and FIGS. 2A-2J, respectively, substantially correspond to the substructure assembly "301" of FIGS. 3A-3P, the driller's side upper boxes "103*b*" and "203*b*" correspond to equipment the driller's side upper box "303*b*," and so on. Accordingly, the reference number designations used to identify some elements of the presently disclosed subject matter may be illustrated in the FIGS. 3A-3P, but may not be fully or specifically described in the following disclosure. In those instances, it should be understood that the numbered elements shown in FIGS. 3A-3P which are not described in detail below substantially correspond with their similarly-numbered counterparts (i.e., other than a leading "3" vs. a leading "1" or "2") illustrated in FIGS. 1A-1H and/or FIGS. 2A-2J, as described in the associated disclosure set forth above.

FIGS. 3A and 3B are exploded driller's side and front end elevation views, respectively, of an exemplary substructure assembly 301 that is, in some aspects, configured substantially the same as the substructure assemblies 101 and 201 described above. As shown in FIGS. 3A-3B, the various elements of the substructure assembly 301 have been moved apart and separated, or "exploded," for additional clarity. In certain embodiments, the substructure assembly 301 may include an upper substructure box assembly 303 that is positioned above a lower substructure box assembly 302. It should be appreciated that when the substructure assembly 301 is fully assembled, that is, not "exploded" as shown in FIGS. 3A-3B, the upper substructure box assembly 303 may be fixedly and removably attached to the lower substructure box assembly 302, as previously described with respect to the substructure assembly 101 above.

As shown in the exemplary embodiment depicted in FIGS. 3A-3B, the lower substructure box assembly 302 may include a front side lower box 302*a*, a back side lower box 302*b*, and a middle lower box 302*c* positioned therebetween that, when assembled, is fixedly and removably attached to the back side lower box 302*b*. The upper substructure box assembly 303 may include an off-driller's side upper box 303*a* and a driller's side upper box 303*b*, which, when fully assembled into the substructure assembly 301, are separated by the center floor section 303*c*, as shown in FIG. 3B. In some illustrative embodiments, the upper and lower substructure box assembly 303, 302 may be configured so that each of the three lower substructure boxes 302*a-c* extend laterally across the width 302*w* (see, FIGS. 3C-3K) of the lower substructure box assembly 302, that is, from the driller's side of the substructure assembly 301 to the off-driller's side. (See, e.g., driller's side 112 and off-driller's side 113 shown in FIG. 1B). Additionally, the upper and lower substructure box assemblies 303, 302 may be further configured so that each of the two upper substructure boxes 303*a/b* extend the full length 303L (see, FIGS. 3L-3P) of the upper substructure box assembly 303 and in a transverse direction across the three lower substructure boxes 302*a-c*, that is, from the V-door/front side of the substructure assembly 301 to the drawworks/back side, such that the upper substructure boxes 303*a/b* are substantially perpendicular to the lower substructure boxes 302*a-c*. (See, e.g., V-door/front side 110 and drawworks/back side 111 shown in FIG. 1B). In this way, the overall lateral and transverse structural stability of the substructure assembly 301 may be enhanced after the two upper substructure boxes 303*a/b* have been assembled, i.e., fixedly attached, to the three lower substructure boxes 302*a-c*.

FIGS. 3C-3E are various views of the front side lower box 302*a* of the lower substructure box assembly 302 shown in FIG. 3A. In particular, FIG. 3C is a plan view of the front side lower box 302*a* taken along the view line "3C-3C" shown in FIG. 3A, and FIGS. 3D and 3E are side and end elevation views, respectively, of the front side lower box 302*a* taken along the view lines "3D-3D" and "3E-3E" as shown in FIG. 3C. As shown in FIGS. 3C-3E, the front side lower box 302*a* has a height 302*h*, a width 312*a*, and an overall length 302*w*, and may be made up of a plurality of structure members 302*s*, such as columns, beams, cross-braces, and the like. Furthermore, in certain illustrative embodiments, at least some of the structural members 302*s* may define a workshop area width 340*w*, as shown in FIG. 3D. The workshop area width may in turn at least partially define the size of an equipment workshop area within the substructure assembly 301, such as the equipment workshop areas 140 and/or 240 described above. Additionally, since the front side lower box 302*a* may generally extend across the full width of the lower substructure box assembly 302, it should be noted that the overall length 302*w* of the front side lower box 302*a* may be substantially the same as the overall width of the substructure assembly 301.

In general, the height 302*h*, width 312*a*, length 302*w*, and workshop area width 340*w* of the front side lower box 302*a* may be adjusted as necessary accordingly the pad drilling requirements at a given site—such as the spacing between adjacent wells—and the design requirements of the substructure assembly 301—such as the number of wells the substructure may be positioned over at any given time, the overhead working requirements within the cellar area of the substructure, and the like. In one exemplary embodiment, the height 302*h* may be approximately 3 meters (10 feet), the width 312*a* may be approximately 2.75 meters (9 feet), the overall length 302*w* may be approximately 11 meters (36.5 feet), and the workshop area width 340*w* may be approximately 3.5 meters (11.5 feet). It should be understood, however, that any or all of these sizes may be varied for at least the reasons set forth above.

FIGS. 3F-3H are various views of the middle lower box 302*c* of the lower substructure box assembly 302 shown in FIG. 3A. In particular, FIG. 3F is a plan view of the middle lower box 302*c* taken along the view line "3F-3F" shown in FIG. 3A, and FIGS. 3G and 3H are side and end elevation views, respectively, of the middle lower box 302*c* taken along the view lines "3G-3G" and "3H-3H" as shown in FIG. 3F. The middle lower box 302*c* has a height 302*h* (i.e., the same as the height 302*h* of the front side lower box 302*a*), a width 312*c*, and an overall length 302*w* (i.e., the same as the length 302*w* of the front side lower box 302*a*). Similarly, the middle lower box 302*c* may also be made up of a plurality of structure members 302*s*, such as columns, beams, cross-braces, and the like. Additionally, as with the front side lower box 302*a*, at least some of the structural members 302*s* may also define a workshop area width 340*w*. Furthermore, the structural members 302*s* may also be arranged so as to define an open area 317*w* through which pressure control equipment (such as BOP's and/or Christmas trees and the like) may be moved back and forth across the middle lower box 302*c* during equipment "leapfrogging" activities, e.g., by using equipment movement means 117 or 217, as described above.

The height 302*h*, width 312*c*, length 302*w*, and workshop area width 340*w* of the middle lower box 302*c* may again be varied as required for the specific overall design requirements of the substructure assembly 301. For example, in certain embodiments, the height 302*h* may be approximately 3 meters (10 feet), the width 312*c* may be approximately 3.75 meters (12.5 feet), the overall length 302*w* may be approximately 11 meters (36.5 feet), and the workshop area width 340*w* may be approximately 3.5 meters (11.5 feet). However, it should be understood that any or all of these sizes may be varied, as noted above.

FIGS. 3I-3K are various views of the back side lower box 302*b* shown in FIG. 3A. More specifically, FIG. 3I is a plan view of the back side lower box 302*b* taken along the view line "3I-3I" shown in FIG. 3A, and FIGS. 3J and 3K are side and end elevation views, respectively, of the back side lower box 302*b* taken along the view lines "3J-3J" and "3K-3K" as shown in FIG. 3I. The back side lower box 302*b* also has a height 302*h* (i.e., the same as the height 302*h* of the front side and middle lower boxes 302*a*, 302*c*), a width 312*c*, and an overall length 302*w* (i.e., the same as the length 302*w* of the front side and middle lower boxes 302*a*, 302*c*). The back side lower box 302*b* may also be made up of a plurality of structure members 302*s*, and as with the front side and middle lower boxes 302*a* and 302*c*, at least some of the structural members 302*s* may also define a workshop area width 340*w*. In some embodiments, the height 302*h* may be approximately 3 meters (10 feet), the width 312*b* may be approximately 3.75 meters (12.5 feet), the overall length 302*w* may be approximately 11 meters (36.5 feet), and the workshop area width 340*w* may be approximately 3.5 meters (11.5 feet), however, these sizes may be varied as required.

FIGS. 3L-3P are various views of the off-driller's side and driller's side upper boxes 303*a/b* of the upper substructure box assembly 303 shown in FIGS. 3A-3B. In particular, FIG. 3L is a plan view of the off-driller's side upper box 303*a* taken along the view line "3L-3L" and FIG. 3N is a plan view of the driller's side upper box 303*b* taken along the view line "3N-3N" in FIG. 3B. Additionally, FIGS. 3M and 3O are end elevation views of the off-driller's side and driller's side upper boxes 303*a/b* taken along the view lines "3M-3M" and "3O-3O" as shown in FIGS. 3L and 3N, respectively, and FIG. 3P is a side elevation view of the upper substructure boxes 303*a/b*, as shown in FIGS. 3N and 3L.

As shown in FIGS. 3L-3P, the off-driller's side and driller's side upper boxes 303*a* and 303*b* both have a height 303*h* and an overall length 303L, and they each have a respective width 313*a* and 313*b*. Additionally, the off-driller's side and driller's side upper boxes 303*a/b* may also be made up of a plurality of structure members 303*s*, such as columns, beams, cross-braces, and the like. Furthermore, the structural members 302*s* may also be arranged so as to define a cellar area width 319*w* within which activities may be performed on the various wellbore location positioned below the substructure assembly 301, and through which pressure control equipment (such as BOP's and/or Christmas trees and the like) may be moved back and forth as described above.

As with the sizes of the various lower substructure boxes 302*a-c*, the height 303*h*, widths 313*a/b*, length 303L, and cellar area width 319*w* of the off-driller's side and driller's side upper boxes 303*a/b* may be adjusted as required to meet the specific overall design requirements of the substructure assembly 301. For example, in at least one embodiment, the height 303*h* of each upper substructure box 303*a/b* may be on the order of about 3 meters (10 feet), each of the widths 313*a/b* may be around 3.75 meters (12.5 feet), the overall length 303L may be approximately 12.75 meters (42 feet), and the cellar area width 319*w* may be about 4.5 meters (14.5 feet). Furthermore, it should be understood that the width 313*a* of the off-driller's side upper box 303*a* need not be the same as the width 313*b* of the driller's side upper box 303*b*. In any event, any and/or all of the various sizes of the upper substructure assembly 303 components may be adjusted, as previously noted.

Finally, it is noted that the specific arrangement of structural members 302*s* and 303*s* depicted in FIGS. 3A-3P are exemplary only and should not otherwise be considered as limiting the scope of the present disclosure. Accordingly, it should be understood that other structural element configurations may also be used based on many different factors, such as design preference, overall design parameters of the substructure assembly 301, and the like.

As a result, the subject matter of the present disclosure provides details of various aspects of the systems and methods that may be used to allow a single mobile drilling rig to be positioned above multiple different wellbore locations of a pad drilling site while simultaneously performing different rig operations, such as wellbore preparation, drilling, and completion operations, on each of the multiple different wellbores. Furthermore, such systems may include means that is adapted to move different types of pressure control equipment, such as blowout preventers (BOP's), Christmas trees, and the like, back and forth between the wellheads of a plurality of different wellbores in a "leapfrog" fashion while the mobile drilling rig is positioned above the different wellbores. Accordingly, several different types of operations that are necessary to prepare, drill, and complete each wellbore may be performed on each of the different wellbores prior to moving the mobile drilling rig to one or more adjacent wellbore locations of the pad drilling site.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system, comprising:

a drilling rig comprising a substructure, said drilling rig being adapted to be positioned above a plurality of wellbore location such that each of said plurality of wellbore locations is simultaneously positioned below said substructure, said drilling rig being further adapted to be moved along a line of wellbore locations comprising at least said plurality of wellbore locations;

equipment movement means for moving one or more pieces of pressure control equipment between positions proximate each of said plurality of wellbore locations, said equipment movement means being adapted to move at least one of said one or more pieces of pressure control equipment between said positions while said drilling rig is performing a rig operation on at least a first one of said plurality of wellbore locations; and equipment positioning means for positioning said one or more pieces of pressure control equipment on one or more of said plurality of wellbore locations, said equipment positioning means being adapted to position at least one of said one or more pieces of pressure control equipment on a second one of said plurality of wellbore locations while said rig operation is being performed on said first wellbore location.

2. The system of claim 1, wherein said equipment positioning means is adapted to lift at least one of said one or more pieces of pressure control equipment from said equipment movement means prior to positioning said lifted pressure control equipment on one of said plurality of wellbore locations.

3. The system of claim 1, wherein said equipment movement means comprises a trolley system.

4. The system of claim 3, wherein said trolley system comprises a rail system and a plurality of trolley cars movably mounted on said rail system, each of said trolley cars being adapted to support at least one of said one or more pieces of pressure control equipment while moving said supported pressure control equipment along said rail system to said positions proximate each of said plurality of wellbore locations, wherein said rail system runs across a width of said substructure from a driller's side of said drilling rig to an off-driller's side of said drilling rig.

5. The system of claim 1, further comprising equipment hoisting means for lifting said one or more pieces of pressure control equipment from said equipment movement means and moving said lifted pressure control equipment into an equipment workshop area within said substructure, wherein said equipment hoisting means is adapted to lift and move at least one of said one or more pieces of said pressure control equipment while said rig operation is being performed on said first wellbore location.

6. The system of claim 1, wherein said equipment positioning means comprises first positioning means for positioning at least one of said one or more pieces of pressure control equipment on a third one of said plurality of wellbore locations and second positioning means for positioning at least one of said one or more pieces of pressure control equipment on said second wellbore location, said first and second positioning means being adapted to position at least one of said one or more pieces of pressure control equipment on said respective third and second wellbore locations while said rig operation is being performed on said first wellbore location.

7. The system of claim 6, wherein at least one of said first and second equipment positioning means comprises a bridge crane.

8. The system of claim 6, wherein said first positioning means, said equipment movement means, and said second positioning means are adapted to sequentially move at least one of said one or more pieces of pressure control equipment from a wellhead at said third wellbore location to a wellhead at said second wellbore location while said rig operation is being performed on said first wellbore location.

9. A system, comprising:

a drilling rig comprising a substructure and a drill floor positioned above said substructure, said drilling rig being adapted to be positioned above a plurality of wellbore location such that each of said plurality of wellbore locations is simultaneously positioned below said substructure, said drilling rig being further adapted to be moved along a line of wellbore locations comprising at least said plurality of wellbore locations;

a plurality of openings in said drill floor, each of said plurality of drill floor openings being adapted to be positioned vertically above and substantially aligned with one of said plurality of wellbore locations;

equipment movement means for moving one or more pieces of pressure control equipment between positions proximate each of said plurality of wellbore locations, said equipment movement means being adapted to move at least one of said one or more pieces of pressure control equipment between said positions while said drilling rig is performing a first rig operation on a first one of said plurality of wellbore locations through a first one of said plurality of drill floor openings; and equipment positioning means for positioning at least one of said one or more pieces of pressure control equipment on one or more of said plurality of wellbore locations, said equipment positioning means being adapted to position at least one of said one or more pieces of pressure control equipment on a second one of said plurality of wellbore locations while said first rig operation is being performed on said first wellbore location through said first drill floor opening.

10. The system of claim 9, wherein said first drill floor opening is substantially vertically aligned with a drilling rig mast of said drilling rig and said first rig operation comprises drilling operation.

11. The system of claim 9, wherein a second one of said plurality of drill floor openings is positioned laterally adjacent to and spaced apart from said first drill floor opening, said second drill floor opening being substantially vertically aligned with a drilling rig mast of said drilling rig.

12. The system of claim 11, wherein said equipment movement means is adapted to move at least one of said one or more pieces of pressure control equipment to a position proximate said second wellbore location and said equipment positioning means is adapted to lift said moved pressure control equipment from said equipment movement means and position said lifted pressure control equipment on said second wellbore location while said drilling rig is performing said first rig operation on said first wellbore location and simultaneously performing a second rig operation on a third one of said plurality of wellbore locations through said second drill floor opening, said first rig operation comprising a cementing operation and said second rig operation comprising a drilling operation.

13. The system of claim 9, wherein said substructure comprises a plurality upper substructure boxes positioned above and removably attached to each of a plurality of lower substructure boxes, a length of each of said plurality of upper substructure boxes running substantially perpendicular to a length of each of said plurality of lower substructure boxes.

14. A system, comprising:

a mobile drilling rig that is adapted to be positioned above a plurality of wellbore locations, said mobile drilling rig comprising a drilling rig mast and a substructure that is configured so that each of said plurality of wellbore locations is simultaneously positioned within a cellar area of said substructure, wherein said mobile drilling rig is adapted to perform an on-line drilling operation on a first one of said plurality of wellbore locations and said drilling rig mast is adapted to be positioned above and substantially aligned with said first wellbore location during said on-line drilling operation, said mobile drilling rig being further adapted to be moved along a line of wellbore locations comprising at least said plurality of wellbore locations;

equipment movement means operatively coupled to said substructure and positioned in said cellar area thereof, said equipment movement means being adapted for moving one or more pieces of pressure control equipment between positions proximate each of said plurality of wellbore locations while said mobile drilling rig is performing said on-line drilling operation on said first wellbore location;

equipment positioning means operatively coupled to said substructure and positioned in said cellar area thereof, said equipment positioning means being adapted for lifting at least one of said one or more pieces of pressure control equipment from said equipment movement means and positioning said lifted pressure control equipment on at least one wellbore location that is immediately adjacent to said first wellbore location while said drilling rig is performing said on-line drilling operation on said first wellbore location.

15. The system of claim 14, wherein said substructure comprises:

a lower substructure box assembly comprising a plurality of lower substructure boxes, wherein a length of each of said plurality of substructure lower boxes runs in a same first direction; and an upper substructure box assembly positioned above and fixed attached to said lower substructure box assembly, said upper substructure box assembly comprising a plurality of upper substructure boxes, a length of each of said plurality of upper substructure boxes running in a same second direction that is substantially perpendicular to said first direction.

16. The system of claim 15, wherein said first direction runs across a width of said substructure from a driller's side of said mobile drilling rig to an off-driller's side of said mobile drilling rig, and said second direction runs along a length of said substructure from a V-door side of said mobile drilling rig to a drawworks side of said mobile drilling rig.

17. The system of claim 14, wherein said mobile drilling rig is further adapted to simultaneously perform at least one off-line operation on said at least one adjacent wellbore location while performing said on-line drilling operation on said first wellbore location.

18. The system of claim 17, wherein said at least one off-line operation comprises at least one of a wellbore preparation operation and a wellbore cementing operation.

19. The system of claim 14, wherein said mobile drilling rig is adapted to be moved along said line of wellbore locations from a first drilling position wherein said drilling rig mast is positioned substantially directly above said first wellbore location to a second drilling position wherein said drilling rig mast is positioned substantially directly above an adjacent wellbore location, said mobile drilling rig being further adapted to thereafter perform a second on-line drilling operation on said adjacent wellbore location.

20. The system of claim 14, wherein said equipment movement means comprises a trolley system, said trolley system comprising a pair of rails and a plurality of trolley cars movably mounted on said rails, wherein each of said plurality of trolley cars is adapted to support at least one of said one or more pieces of pressure control equipment during movement of said respective trolley cars along said rails.

21. The system of claim 14, wherein said equipment positioning means comprises first and second positioning means, wherein said first positioning means is adapted for moving a first one of said one or more pieces of pressure control equipment from a first adjacent wellbore location in said cellar area of said substructure and positioning said first one of said one or more pieces of pressure control equipment on said equipment movement means and said second equipment positioning means is adapted for moving a second one of said one or more pieces of pressure control equipment from a second adjacent wellbore location in said cellar area and positioning said second one of said one or more pieces of pressure control equipment on said equipment movement means while said mobile drilling rig is performing said on-line drilling operation on said first wellbore location.

22. A method,comprising:

positioning a substructure of a mobile drilling rig above at least first and second wellbore locations of wellbore drilling site such that each of said first and second wellbore locations are simultaneously positioned within a cellar area of said substructure and such that a drilling rig mast of said mobile drilling rig is positioned above and substantially aligned with said first wellbore location;

positioning a first blowout preventer on a first wellhead at said first wellbore location;

positioning a second blowout preventer in said cellar area of said substructure;

performing a first on-line drilling operation on said first wellbore location through said first blowout preventer;

moving said second blowout preventer within said cellar area to a second wellhead at said second wellbore location while performing said first on-line drilling operation; and after moving said second blowout preventer, moving said mobile drilling rig until said drilling rig mast is positioned above and substantially aligned with said second wellbore location, and thereafter performing a second on-line drilling operation on said second wellbore location through said second blowout preventer.

23. The method of claim 22, wherein positioning said second blowout preventer in said cellar area of said substructure comprises positioning said second blowout preventer on a third wellhead of a third wellbore location, said second and third wellbore locations being spaced apart from and laterally adjacent to opposite sides of said first wellbore location.

24. The method of claim 23, wherein moving said second blowout preventer to said second wellhead comprises:

using first equipment positioning means to lift said second blowout preventer from said third wellhead and move said second blowout preventer to a position proximate said third wellbore location;

using equipment movement means to move said second blowout preventer from said position proximate said third wellbore location to a position proximate said second wellbore location; and using second equipment positioning means to lift said second blowout preventer from said position proximate said second wellbore location and position said second blowout preventer on said second wellhead.

25. The method of claim 23, further comprising, prior to moving said second blowout preventer to said second wellbore location, performing an off-line cementing operation on said third wellbore location through said second blowout preventer while performing said first on-line drilling operation on said first wellbore location.

26. The method of claim 25, further comprising, after moving said second blowout preventer to said second wellbore location and prior to performing said second on-line drilling operation on said second wellbore location, performing a second off-line operation to position a Christmas tree on said third wellhead at said third wellbore location while performing said first on-line drilling operation on said first wellbore location.

27. The method of claim 22, further comprising, prior to moving said second blowout preventer to said second wellbore location, removing a Christmas tree from said second wellhead at said second wellbore location while performing said first on-line drilling operation on said first wellbore location.

28. The method of claim 22, wherein said first on-line drilling operation is performed with said drilling rig mast.

29. The method of claim 28, wherein said second on-line drilling operation is performed on said second wellbore location after completing said first on-line drilling operation on said first wellbore location, said second on-line drilling operation being performed with said drilling rig mast.

30. The method of claim 29, wherein moving said mobile drilling rig comprises positioning said substructure above a third wellbore location of said wellbore drilling site so that each of said first, second, and third wellbore locations are simultaneously positioned within said cellar area of said substructure.

31. The method of claim 30, further comprising moving said first blowout preventer from said first wellhead to a third wellhead at said third wellbore location and performing a third on-line drilling operation on said third wellbore location through said first blowout preventer.

32. The method of claim 31, further comprising, prior to moving said first blowout preventer from said first wellhead to said third wellhead, performing an off-line cementing operation on said first wellbore location through said first blowout preventer while performing said second on-line drilling operation on said second wellbore location.

* * * * *